US009604129B2

(12) United States Patent
Stellenberg

(10) Patent No.: US 9,604,129 B2
(45) Date of Patent: Mar. 28, 2017

(54) PINBALL MACHINE WITH ANIMATED PLAYFIELD COMPONENTS AND AUTOMATIC LEVEL DETECTION

(71) Applicant: Multimorphic, Inc., Austin, TX (US)

(72) Inventor: Gerald Stellenberg, Austin, TX (US)

(73) Assignee: Multimorphic Inc., Austin, TX (US)

( * ) Notice: Subject to any disclaimer, the term of this patent is extended or adjusted under 35 U.S.C. 154(b) by 233 days.

(21) Appl. No.: 13/933,590

(22) Filed: Jul. 2, 2013

(65) Prior Publication Data

US 2013/0300058 A1 Nov. 14, 2013

Related U.S. Application Data

(63) Continuation-in-part of application No. 13/734,151, filed on Jan. 4, 2013, which is a continuation-in-part of application No. 13/777,865, filed on Feb. 26, 2013.

(60) Provisional application No. 61/632,002, filed on Jan. 17, 2012, provisional application No. 61/632,749, filed on Jan. 31, 2012, provisional application No. 61/633,559, filed on Feb. 14, 2012, provisional (Continued)

(51) Int. Cl.

| | |
|---|---|
| ***A63F 7/02*** | (2006.01) |
| ***G07F 17/32*** | (2006.01) |
| *A63F 9/24* | (2006.01) |

(52) U.S. Cl.

CPC ..... *A63F 7/027* (2013.01); *G07F 17/323* (2013.01); *G07F 17/3211* (2013.01); *G07F 17/3216* (2013.01); *A63F 2009/246* (2013.01); *A63F 2009/2442* (2013.01); *G07F 17/3297* (2013.01)

(58) Field of Classification Search

CPC ..... A63F 9/24; G06F 19/00

USPC ..... 463/1, 20; 273/118 R, 121 A

See application file for complete search history.

(56) References Cited

U.S. PATENT DOCUMENTS 4,448,417 A * 5/1984 Clark et al. ..... 273/121 A
5,611,731 A * 3/1997 Bouton et al. ..... 463/37

(Continued)

OTHER PUBLICATIONS

Pinball News, P3 Pinball Platform, published on Mar. 23, 2012 at http://www.pinballnews.com/learn/p3, last accessed on Dec. 28, 2012.

(Continued)

*Primary Examiner* — Dmitry Suhol
*Assistant Examiner* — Ankit Doshi
(74) *Attorney, Agent, or Firm* — Boisbrun Hofman, PLLC

(57) ABSTRACT

Pinball machines with animated playfield components and automatic level detection are described. In an illustrative, non-limiting embodiment, a method may include changing a visual appearance of a surface of a physical object within a pinball machine, the physical object configured to physically interact with a pinball during a pinball game. In another illustrative, non-limiting embodiment, a pinball machine may be configured to receive leveling information detected by one or more accelerometers, the leveling information selected from the group consisting of: pitch, roll, and yaw. In yet another illustrative, non-limiting embodiment, a pinball machine may be configured to periodically or continuously receive leveling information detected by one or more accelerometers during a pinball game, and then discourage the player from applying force to the pinball machine in response to the leveling information meeting a value and/or encourage a player to apply force to the pinball machine.

14 Claims, 17 Drawing Sheets

Related U.S. Application Data application No. 61/634,352, filed on Feb. 28, 2012, provisional application No. 61/685,588, filed on Mar. 21, 2012, provisional application No. 61/685,644, filed on Mar. 22, 2012, provisional application No. 61/690,711, filed on Jul. 3, 2012, provisional application No. 61/741,126, filed on Jul. 13, 2012.

(56) References Cited

U.S. PATENT DOCUMENTS

| | | | | |
|---|---|---|---|---|
| 6,036,188 | A | 3/2000 | Gomez | |
| 2005/0245302 | A1* | 11/2005 | Bathiche et al. | 463/1 |
| 2011/0263312 | A1* | 10/2011 | De Waal et al. | 463/20 |

OTHER PUBLICATIONS

Pinball News, P3 Update:Team Adds New Game Designer, published on Dec. 5, 2012 at http://www.pinballnews.com/games/p3/index4.html, last accessed on Dec. 28, 2012.

* cited by examiner

PINBALL MACHINE WITH ANIMATED PLAYFIELD COMPONENTS AND AUTOMATIC LEVEL DETECTION

CROSS-REFERENCE TO RELATED APPLICATIONS

This application claims priority to, and is a Continuation-In-Part (CIP) of, U.S. patent application Ser. No. 13/734,151 filed on Jan. 4, 2013, which claims the priority of U.S. Provisional Patent Application No. 61/632,002 filed on Jan. 17, 2012, of U.S. Provisional Patent Application No. 61/632,749 filed on Jan. 31, 2012, and of U.S. Provisional Patent Application No. 61/633,559 filed on Feb. 14, 2012, the disclosures of which are hereby incorporated by reference herein in their entirety. This application also claims priority to, and is a Continuation-In-Part (CIP) of, U.S. patent application Ser. No. 13/777,865 filed on Feb. 26, 2013, which claims the priority of U.S. Provisional Patent Application No. 61/634,352 filed on Feb. 28, 2012, of U.S. Provisional Patent Application No. 61/685,588 filed on Mar. 21, 2012, and of U.S. Provisional Patent Application No. 61/685,644 filed on Mar. 22, 2012, the disclosures of which are hereby incorporated by reference herein in their entirety. This application further claims priority to U.S. Provisional Patent Application No. 61/690,711 filed on Jul. 3, 2012, and U.S. Provisional Patent Application No. 61/741,126 filed on Jul. 13, 2012, the disclosures of which are hereby further incorporated by reference herein in their entirety.

FIELD

This document relates generally to gaming devices, and more specifically, to pinball machines with animated playfield components and automatic level detection.

BACKGROUND

A pinball machine is an entertainment or amusement device usually found in a variety of public places such as arcades, restaurants, bars, clubs, etc., but sometimes also present in private residences and other environments. Generally speaking, a conventional or traditional pinball machine allows players to play a game in which points are earned by physically manipulating one or more steel balls on a slightly inclined playfield within a glass-covered cabinet.

The pinball machine's playfield typically includes one or more physical targets. When a ball strikes a particular physical target, an electromechanical switch coupled to (or otherwise integrated into) the target detects the mechanical impact, which then triggers a change in some aspect of the game. For example, in some cases, when a ball hits a given target, a player may score a predetermined amount of points.

In most pinball implementations, a "hole" or "drain" is located at the bottom portion of the playfield. Usually, if the ball falls into the drain, the game ends or another ball is provided to the player. Mechanical "flippers" capable of at least partially covering the drain may allow a skilled player to hit the ball at an appropriate time so as to prevent it from falling into the drain, thus putting that same ball back in play and extending the duration of the game.

SUMMARY

Pinball machines with animated playfield components and automatic level detection are described. In an illustrative, non-limiting embodiment, a method may include changing a visual appearance of a surface of a physical object within a pinball machine, the physical object configured to physically interact with a pinball during a pinball game. For example, the physical object may include a flipper, slingshot, or target. Also, changing the visual appearance of the surface may include causing the surface to convey at least one of: a text, a graphic, or a color.

In some implementations, the surface may include a display, and changing the visual appearance of the surface may include rendering an image on the display. In other embodiments a playable surface accessible to the pinball during the pinball game may include a display, the physical object may be located above the display, the surface of the physical object may include a transparent or translucent portion, and changing the visual appearance of the surface of the physical object may include rendering an image on the display, the image being visible to a player through the transparent or translucent portion.

As such, the method may include changing the visual appearance of the surface while the physical object moves during the pinball game or over a time interval. In some cases, the surface may have a first physical appearance when a given pinball is being played, and a second physical appearance when a subsequent pinball is being played. Moreover, changing the visual appearance of the surface may include conveying leveling information, the leveling information being detected by one or more accelerometers coupled to the pinball machine.

In another illustrative, non-limiting embodiment, a pinball machine may include a memory configured to store instructions and processing circuitry operably coupled to the memory, the processing circuitry configured to execute the instructions to cause the pinball machine to receive leveling information detected by one or more accelerometers, the leveling information selected from the group consisting of: pitch, roll, and yaw. The processing circuitry may be further configured to execute the instructions to cause the pinball machine to provide at least one of: a textual, graphical, or audio indication of the leveling information. In some cases, the indication may be provided to a computing device remotely located with respect to the pinball machine, at least in part, via a telecommunications network.

For instance, the instructions may be executable as part of a setup procedure of the pinball machine, and the indication may be provided to an installer. Additionally or alternatively, the indication may be provided to a prospective player of the pinball machine.

In some implementations, the processing circuitry may be further configured to execute the instructions to cause the pinball machine to allow a player to start a game in response to the leveling information meeting a threshold value. Additionally or alternatively the instructions may be executable as part of a pinball game, and the one or more accelerometers may be configured to determine that a player has physically moved the pinball machine. For instance, the one or more accelerometers may be coupled to a playfield surface of the pinball machine.

In yet another illustrative, non-limiting embodiment, a non-transitory computer-readable storage medium may have instructions stored thereon that, upon execution by a processor within a pinball machine, cause the pinball machine to periodically or continuously receive leveling information detected by one or more accelerometers during a pinball game, and perform at least one of: discourage the player from applying force to the pinball machine in response to the leveling information meeting a value, or encourage a player to apply force to the pinball machine.

In some cases, to encourage the player to apply force, the instructions may cause the pinball machine to perform at least one of: award a point, award a credit, award an extra pinball, render a virtual object on a display, stop rendering the virtual object on a display, or animate a virtual object on the display. The instructions may further cause the pinball machine to stop encouraging the player to apply force in response to the leveling information meeting a value. In other cases, to discourage the player from applying force, the instructions may cause the pinball machine to perform at least one of: take away a point, take away a credit, take away a pinball, increase the speed of a countdown timer, present an additional target to shoot, or disable a control.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Systems and methods disclosed herein are directed to pinball machines with hybrid playfields and methods of operating the same. Generally speaking, some of these systems and methods may be incorporated into, or otherwise combined with, a wide range of other entertainment or amusement devices, including, but not limited to, video games, electro-mechanical games, redemption games, merchandisers, billiards, shuffleboards, table football ("Foosball"), table tennis ("Ping-Pong"), air hockey tables, etc. These systems and methods may also be incorporated into gambling devices, such as slot machines, pachinko machines, or the like. It should be noted, however, that some of the techniques discussed herein may be uniquely applicable to devices that allow a player to manipulate a physical object within a playfield without directly touching that physical object (e.g., pinball machines).

Figure 1:
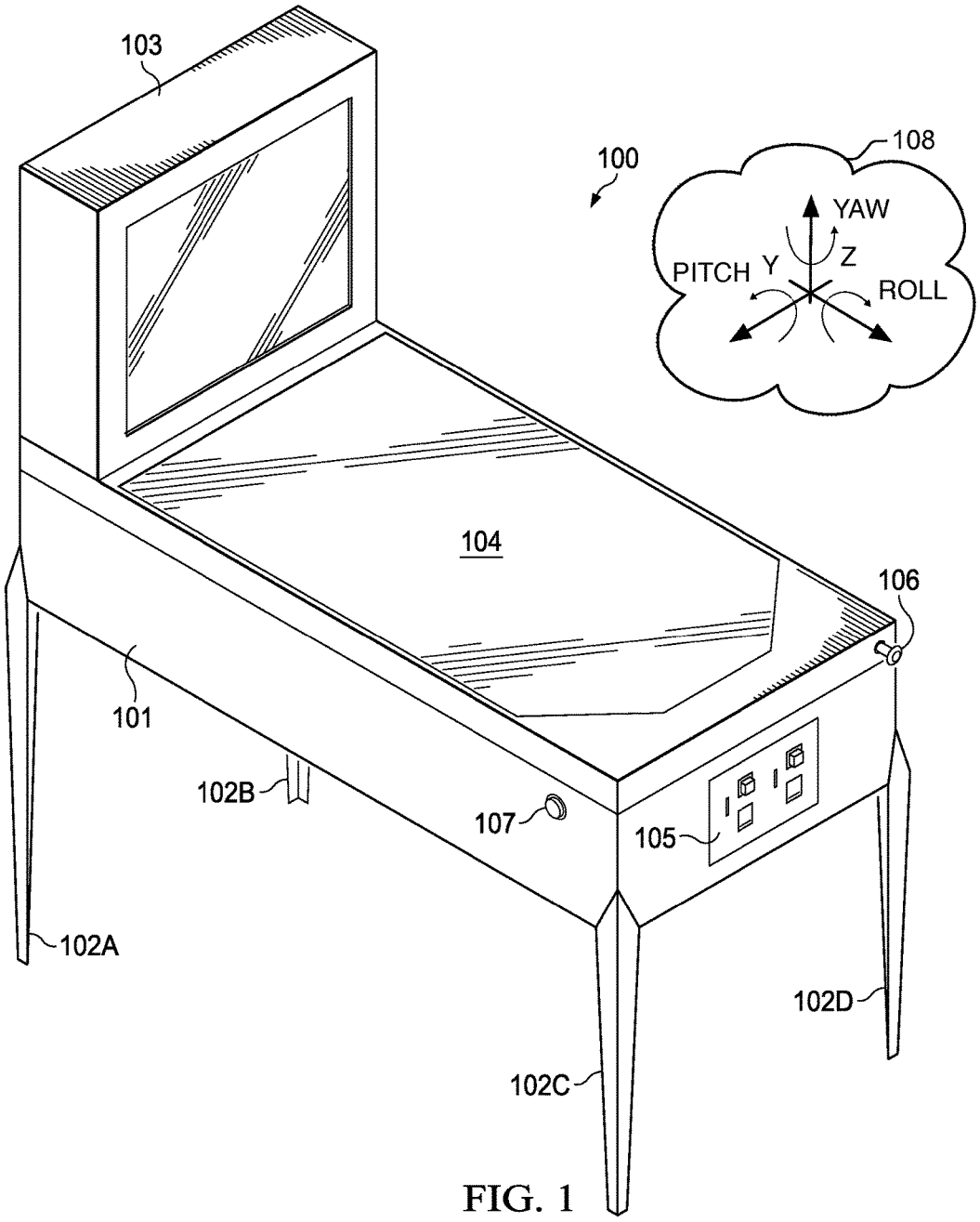
FIG. 1 is a three-dimensional, auxiliary view of an example of a pinball machine according to some embodiments.

Turning to FIG. 1, a three-dimensional, auxiliary view of an example of pinball machine 100 is depicted according to some embodiments. As illustrated, cabinet 101 stands on legs 102A-D, although in other implementations legs 102A-D may be absent and cabinet 101 may sit on a stand, desk, table, countertop, or the like. Cabinet 101 includes hybrid playfield 104, where a game of pinball may take place. Examples of hybrid playfield 104 are discussed in more detail below. In some cases, legs 102A and 102B may be slightly longer than legs 102C and 102D, such that playfield 104 may have an angle of approximately 3.5° to 10.5° with respect to the ground ("pitch"). Accordingly, playfield 104 may be said to have an approximately horizontal surface. In other cases, legs 102A-D may each have the same length, and cabinet 101 may be constructed so as to provide a suitable pitch to hybrid playfield 104.

Vertical portion 103 may include one or more electronic displays, video cameras, loudspeakers, etc. Generally speaking, vertical portion 103 may include or otherwise present certain audio-visual information, whether related or unrelated to a pinball game playable on machine 100 (e.g., promotional or marketing materials, etc.).

To enable a player to play a pinball game, front control(s) 105 may allow the user or player to deposit money or tokens into machine 100. As such, front control(s) 105 may include, for example, a credit, coin or token receiver, a magnetic card reader, a Radio Frequency Identification (RFID) scanner, or the like. Front control(s) 105 may also include one or more buttons that allow a user to select a number of players for a particular game, or to simply to start a pinball game. Meanwhile, side control(s) 107 and playfield control(s) 106 allow the user to operate one or more physical objects within hybrid playfield 104. As an example, side control(s) 107 (and/or a corresponding control on the opposite side of cabinet 101, not shown) may include one more buttons that allow a player to control mechanical "flippers." As another example, playfield control(s) 106 may include one or more buttons or mechanisms that allow the player to control a "plunger" element configured to put a steel ball in play during a pinball game.

Here it should be noted that pinball machine 100 is provided by way of illustration only. In different applications, machine 100 may assume a variety of shapes and forms. Furthermore, one or more components discussed above may be absent or different from what is depicted in FIG. 1. For example, in some cases, front control(s) 105 may be located elsewhere on machine 100, and, in other cases, may include more or fewer elements than shown. For instance, when designed for residential or personal use, machine 100 may not be credit, coin or token-operated. Similarly, side control(s) 107 and/or playfield control(s) 106 may be replaced with motion detection devices (e.g., integrated into vertical portion 103), or may not be necessary for certain games. For example, if steel balls are provided within playfield 104 via an internal mechanism within machine 100, then playfield control(s) 106 may not be necessary.

To facilitate understanding of some of the systems and methods introduced below, a three-dimensional (XYZ) coordinate system 108 is also shown in FIG. 1. As illustrated, an angle and/or rotation around the x axis is referred to as "roll," an angle and/or rotation around the y axis is referred to as "pitch," and an angle and/or rotation around the z axis is referred to as "yaw." As discussed in more detail below, in some implementations, pinball machine 100 and/or playfield 104 may include one or more accelerometers configured to evaluate leveling information based, at least in part, upon pitch, roll, and/or yaw measurements. Here, for ease of explanation, the lateral portion of pinball machine 100 is disposed along the x axis and the front portion of pinball machine 100 is disposed along the y axis.

Figure 2:
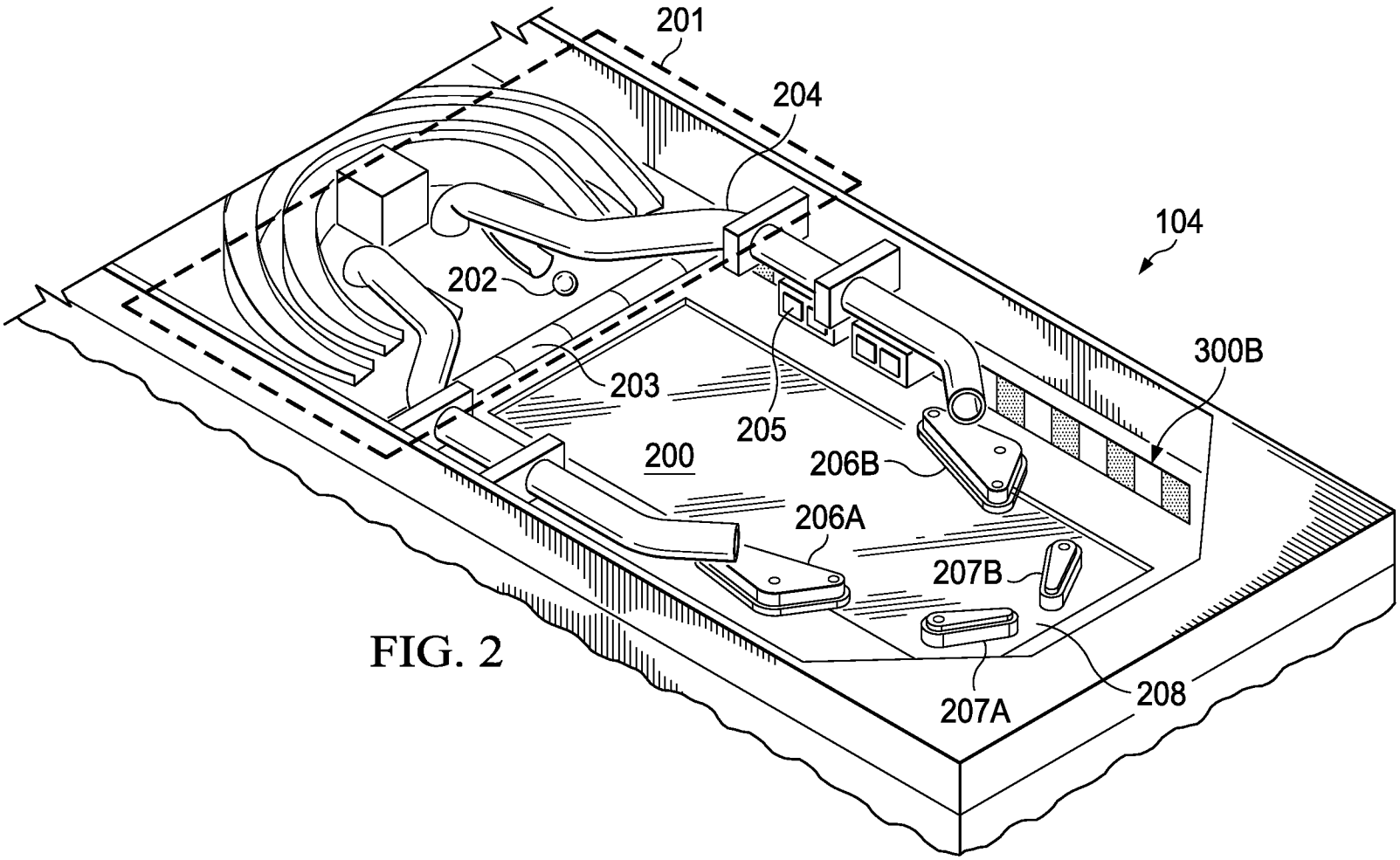
FIG. 2 is a three-dimensional, auxiliary view of an example of a hybrid playfield according to some embodiments.

FIG. 2 is a three-dimensional, auxiliary view of an example of hybrid playfield 104 according to some embodiments. Generally speaking, a "playfield" is a mostly flat surface over which one or more objects, such as pinball 202, move in an amusement game, such as a pinball game. Hybrid playfield 104 is a playfield comprising a "physical space" and a "virtual space." The physical space may include one or more mechanical or electromechanical elements, also referred to herein as "physical objects." Electronic display 200 may provide the virtual space portion of hybrid playfield 104 by rendering one or more graphical elements referred to herein as "virtual objects."

In the case of a pinball machine, examples of hybrid playfield 104's physical objects include, but are not limited to, ball(s), plunger(s), bumper(s), kicker(s), bullseye target(s), drop target(s), variable point target(s), roll(s), saucer(s), spinner(s), rollover(s), switch(es), gate(s), stopper(s), ramp(s), toy(s), electromagnet(s), etc. Meanwhile, virtual objects may include any graphical or digital element that may be rendered on electronic display 200, such as, for example, artwork, colors, images, animations, photographs, designs, etc.

In various implementations, systems and methods described herein may allow certain physical objects to cause changes to certain virtual objects and/or vice-versa. Accordingly, these systems and methods may create an impression or an illusion upon a player that physical and virtual elements are interacting during a game, for example, in a physical or mechanical manner.

In the illustrated embodiment, hybrid playfield 104's physical objects include modular portion 201 configured to deploy one or more ball(s) 202 onto the playfield during a game. In this example, modular portion 201 includes barrier element(s) 203 and pipe element(s) 204. Barrier element(s) 203 may include one or more walls that can pop-up and at least partially block pinball 202 from transiting between modular portion 201 and other portion(s) of hybrid playfield 104. In some cases, barrier element(s) 203 may act as a "trap" to cause pinball 202 to fall under the surface of hybrid playfield 104 or become more or less static for a predetermined amount of time (e.g., by including an electromagnet or the like), for example. Meanwhile, pipe element(s) 204 may allow pinball 202 to travel through predetermined paths or "shortcuts" when traveling within hybrid playfield 104.

Once deployed, pinball 202 may tend to roll towards drain 208 depending upon the pitch of playfield 104 and absent action by a player operating flippers 207A and/or 207B. Flippers 207A and/or 207B are mechanically or electromechanically-controlled levers used for redirecting pinball 202 up playfield 104, preventing pinball 202 from falling into drain 208. Through the use of careful, skillful timing, a player may also be to manipulate flippers 207A and/or 207B to intentionally direct pinball 202 in a selected direction with a given speed, thus causing pinball 202 to hit various types of scoring targets, such as, for example, one or more trigger elements 205 and/or slingshots 206A and 206B.

With respect to hybrid playfield 104's virtual objects, electronic display 200 may be any suitable display or monitor (e.g., a Liquid Crystal Display (LCD) or the like) configured to present graphical designs and/or animations to a player. These virtual objects are configurable depending upon the design of a game, and may interact with certain physical objects in hybrid playfield 104. In some implementations, electronic display 200 may be capable of rendering 2D virtual objects on a flat screen. Additionally or alternatively, electronic display 200 may be capable of producing 3D and/or holographic virtual objects.

Although shown as a single display in FIG. 2, in other embodiments two or more electronic displays 200 may be disposed in playfield 104. For example, in some cases, a first electronic display and a second electronic display may be positioned side-by-side. In other cases, four electronic displays may be arranged such that each occupies a different quadrature of playfield 104. Furthermore, in some cases, electronic display 200 may be at least in part co-extensive with the surface of hybrid playfield 104.

As discussed in more detail below, pinball 202 may cause one or more virtual objects rendered by electronic display 200 to appear, disappear, or change depending upon its position on hybrid playfield 104. Similarly, when pinball 202 physically interacts with trigger element 205 and slingshots 206A and 206B, for example, one or more virtual objects presented on electronic display 200 may change their behavior in an appropriate manner. Conversely, virtual objects rendered on electronic display 200 may also behave in a way so as to cause a change in one or more of trigger element 205 and slingshots 206A and 206B, for example, thus appearing to a player as if a physical interaction between the virtual object and the physical object has taken place.

In some cases, in order to enable one or more of the foregoing operations, a tracking system may be disposed within machine 100 to determine a position of pinball 202 and/or other physical objects. For instance, one or more arrays of infrared (IR) transducers may be disposed immediately above the surface of hybrid playfield 104 along one or more sides of electronic display 200.

Figure 3:
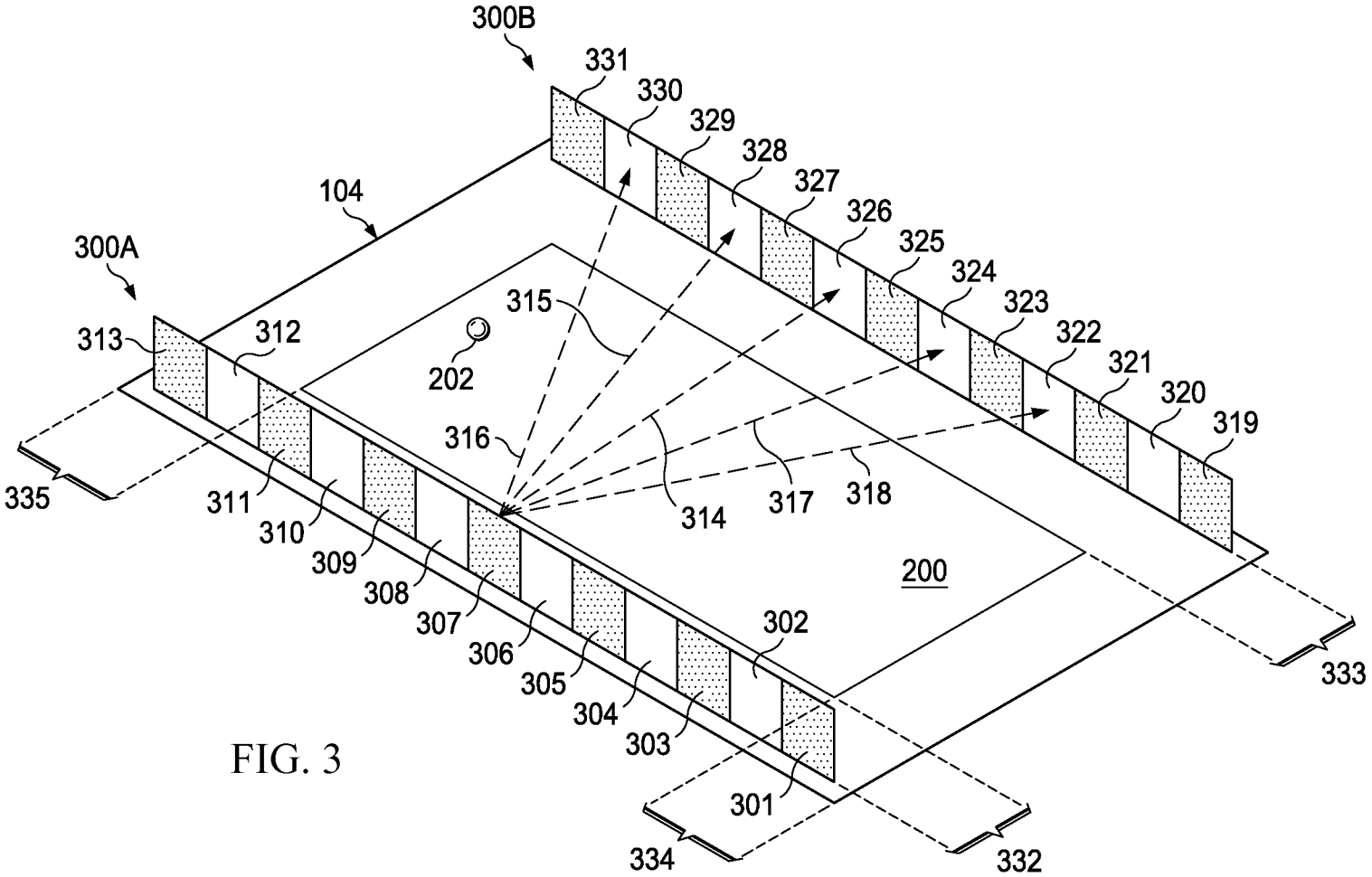
FIG. 3 is a three-dimensional, auxiliary view of an example of a tracking system in a hybrid playfield according to some embodiments.

Turning now to FIG. 3, a three-dimensional, auxiliary view of an example of tracking system 300 in hybrid playfield 104 is depicted according to some embodiments. As illustrated, tracking system 300 includes first IR transducer array 300A and second IR transducer array 300B. Arrays 300A and 300B are disposed immediately above the surface of playfield 104 on opposite sides of electronic display 200, and may be positioned such that other playfield components (e.g., trigger element 205, slingshots 206A and 206B, flippers 207A and 207B, etc.) do not interfere with its operations—that is, so that array 300A may have a least a partial direct line-of-sight with respect to array 300B. For instance, one or more of these playfield components may be "floating" with respect to electronic display 200 (e.g., attached or coupled to the top or cover of hybrid playfield 104).

In this example, arrays 300A and 300B are positioned at distances 332 and 333 from the sides of electronic display 200, and are longer than the height of electronic display 200 by lengths 334 and 335. In some implementations, distances and lengths 332-335 may be selected to avoid interfering with gameplay (i.e., without blocking pinball 202's access to modular portion 201 or drain 208). Also, in cases where electronic display 200 extends to the edge of hybrid playfield 104, one or more of distances and lengths 332-335 may be zero and/or transducer arrays 300A and 300B may be positioned outside of hybrid playfield 104.

In this embodiment, IR transducer array 300A includes transmitter elements 301, 303, 305, 307, 309, 311, and 313 alternating with receiver or detector elements 302, 304, 306, 308, 310, and 312. Second IR transducer array 300B includes transmitter elements 319, 321, 323, 325, 327, 329, and 331 alternating with receiver or detector elements 320, 322, 324, 326, 328, and 330. It should be noted, however, that this particular configuration is provided for ease of explanation only, and that many other suitable configurations with a different number of arrays, transmitter elements, and detector elements may be used, sometimes in the same pinball machine 100. For instance, in other embodiments, tracking system 300 may include RF triangulation systems, video based motion tracking systems, capacitive systems, or other electro-mechanical position detection systems.

Figure 7:
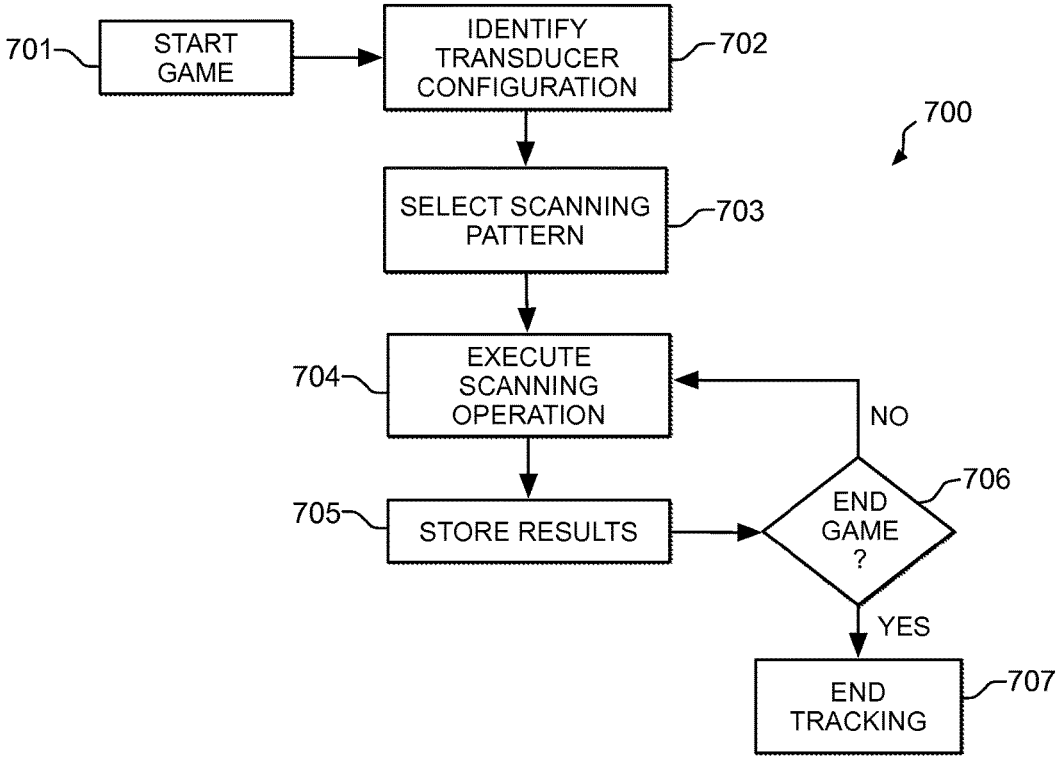
FIG. 7 is a flowchart of an example of a method of operating a tracking system in a hybrid playfield according to some embodiments.
Figure 8:
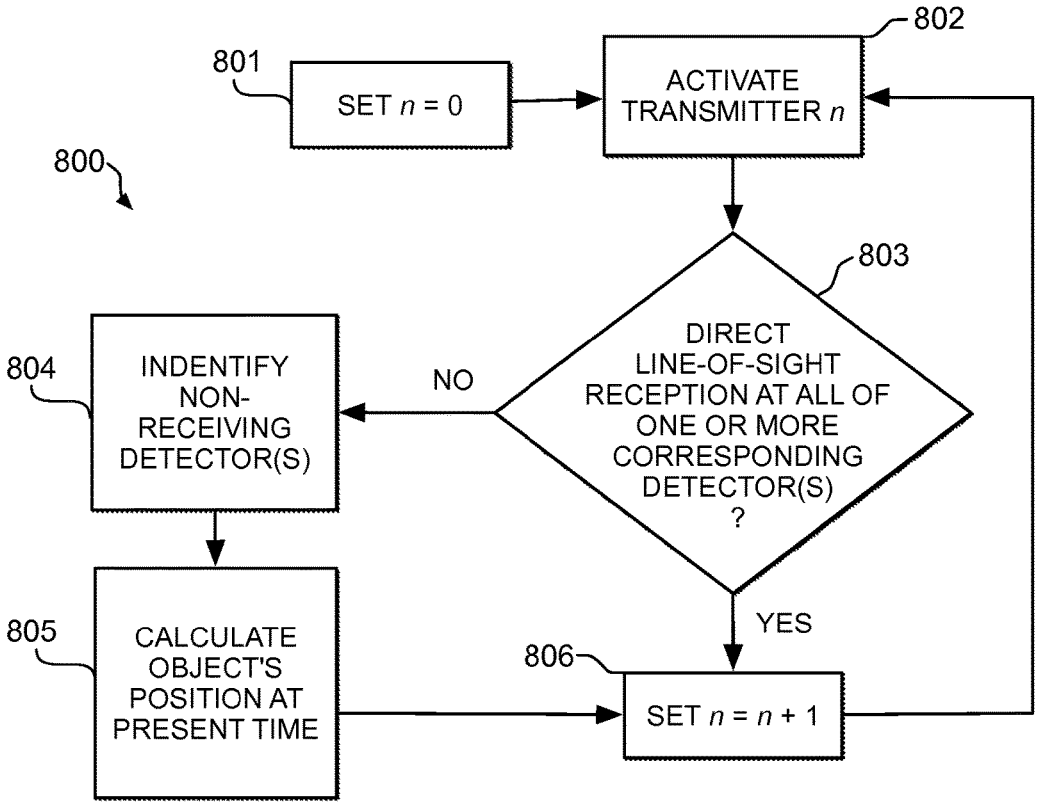
FIG. 8 is a flowchart of an example of a method of obtaining an object's position in a hybrid playfield using a tracking system according to some embodiments.

Tracking system 300 may be configured to scan hybrid playfield 104, for example, as explained in FIGS. 7 and 8. Briefly, each of transmitter elements 301, 303, 305, 307, 309, 311, and 313 of first array 300A may transmit IR signals in succession such that one or more of detector elements 320, 322, 324, 326, 328, and/or 330 of second array 300B receives these signals. Then, each of transmitter elements 319, 321, 323, 325, 327, 329, and 331 of second array 300B may transmit IR signals in succession such that one or more of detector elements 302, 304, 306, 308, 310, and/or 312 of first array 300A receives those signals. By determining which of detector elements 302, 304, 306, 308, 310, 312 320, 322, 324, 326, 328, and/or 330 were expected to receive their respective signals but did not, for example, because pinball 202 was blocking that detector's line-of-sight, tracking system 300 may determine the position of pinball 202 as it moves across hybrid playfield 104.

In some embodiments, tracking system 300 may be configured to determine the position, speed, and/or direction of movement of a physical object over hybrid playfield 104 with a margin of error no larger than the size of the physical object itself. Tracking system 300 may also be configured to determine the identification of a particular physical object, for example, when two balls 202 occupy hybrid playfield 104 simultaneously (e.g., via a chip or tag included in each pinball 202, by maintaining a record of which ball gets deployed at what time and their respective trajectories, etc.). In some implementations, two or more tracking systems 300 may be used in the same hybrid playfield 104, and each of the two or more tracking systems 300 may be of a different type (e.g., an IR system and an RFID system, etc.).

Figure 4:
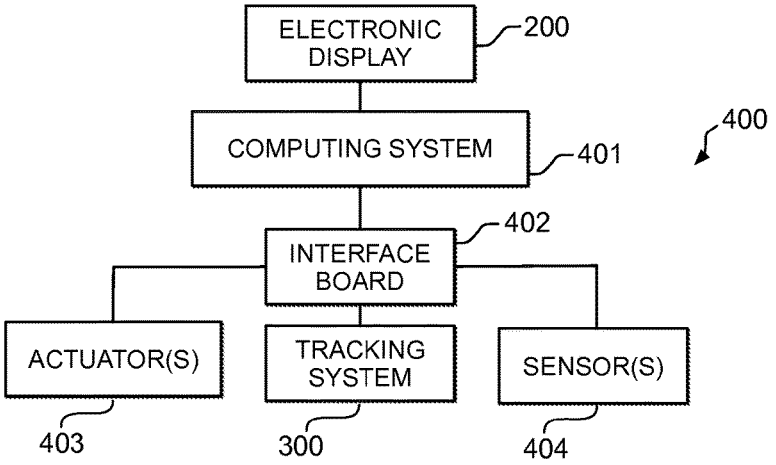
FIG. 4 is a block diagram of an example of hardware elements of a pinball machine with a hybrid playfield according to some embodiments.

FIG. 4 is a block diagram of an example of hardware elements 400 in pinball machine 100 with hybrid playfield 104 according to some embodiments. As shown, computing system or controller 401 is coupled to electronic display 200 of FIG. 2. Computing system 401 is also coupled to (or otherwise includes) interface board 402, which in turn is coupled to tracking system 300, actuator(s) 403, and/or sensor(s) 404.

In operation, computing system 401 may be configured to control electronic display 200 by providing one or more video signals capable of being rendered by electronic display 200 to create one or more 2D or 3D virtual objects in hybrid playfield 104 during a pinball game. Also, through interface board 402, computing system 401 may be configured to control the behavior of and/or to receive information related to physical objects in hybrid playfield 104 through interface board 402.

In some embodiments, interface board 402 may be any suitable pinball controller device such as, for example, the "Pinball—Remote Operations Controller" or "P-ROC" controller available from Multimorphic, Inc., which enables a computer to control a pinball machine over Universal Serial Bus (USB). It should be noted, however, that other pinball controller devices may be used as interface board 402, and that such a device may communicate with computing device 401 using any suitable bus and/or communication protocol.

In some cases, interface board 402 may be configured to control actuator(s) 403, such as, for example, coils, motors, etc. to thereby affect the behavior or status of physical elements, such as, for example, pinball 202, barrier element 203, pipe element 204, trigger element 205, slingshots 206A and 206B, flippers 207A and 207B, or the like. Moreover, interface board 402 may be configured to receive information from sensor(s) 404 such as, for example, switches, optical sensors, accelerators, etc., to determine the status of those physical objects. With regard to certain physical objects, such as, for example, pinball 202, interface board 402 may also be configured to control tracking system 300 to obtain position and other information about those elements.

Figure 5:
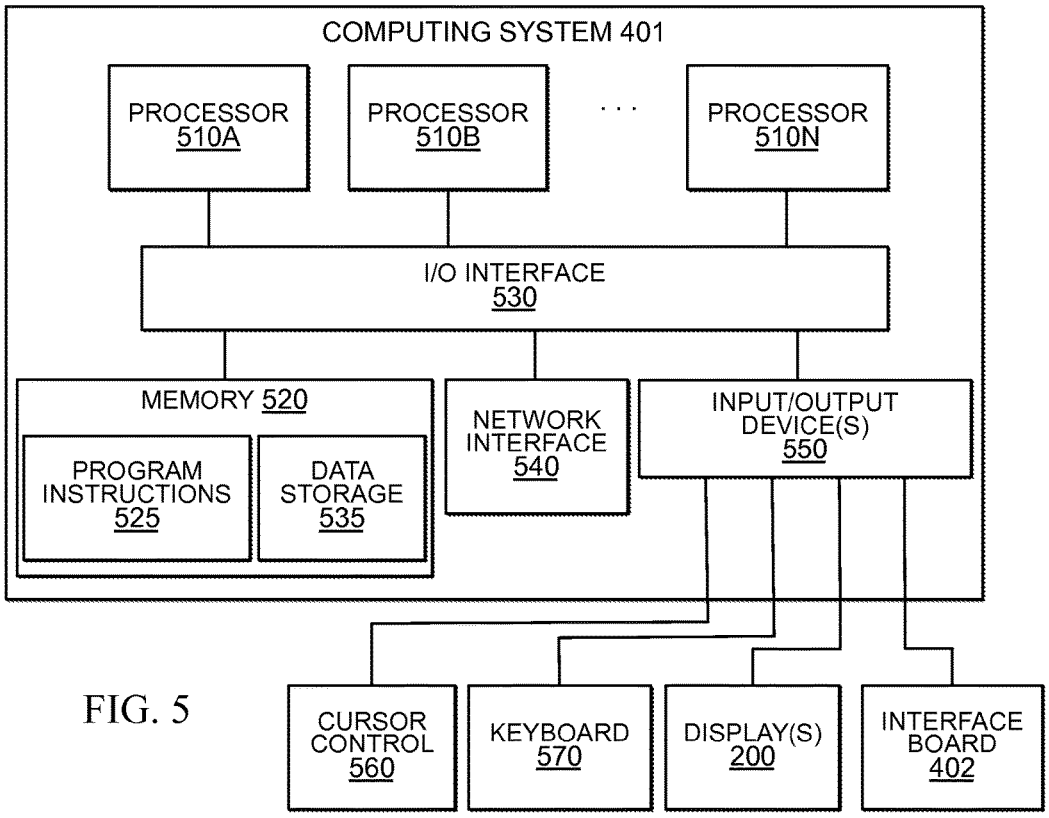
FIG. 5 is a block diagram of an example of a computing system or controller configured to implement aspects of a pinball machine with a hybrid playfield according to some embodiments.

FIG. 5 is a block diagram of an example of computing system 401 configured to implement aspects of pinball machine 100 with a hybrid playfield 104. In some embodiments, computing system 401 may be a server, a mainframe computer system, a workstation, a network computer, a desktop computer, a laptop, or the like. In other embodiments, one or more of the components described in connection with computing system 401 may be provided as a System-On-Chip (SoC), Application Specific Integrated Circuit (ASIC), or the like. More generally, however, computing system 401 may be any system, device, or circuitry capable of implementing or executing one or more of the various operations described herein.

In some implementations, computer system 401 may include one or more processors 510A-N coupled to a system memory 520 via an input/output (I/O) interface 530. Computing system 401 may further include a network interface 540 coupled to I/O interface 530, and one or more input/output devices 550, such as cursor control device 560, keyboard 570, electronic display(s) 200, and interface board 402.

In various embodiments, computing system 401 may be a single-processor system including one processor 510A, or a multi-processor system including two or more processors 510A-N (e.g., two, four, eight, or another suitable number). Processor(s) 510A-N may be any processor capable of executing program instructions. For example, in various embodiments, processor(s) 510A-N may be general-purpose or embedded processors implementing any of a variety of instruction set architectures (ISAs), such as the x86, POWERPC®, ARM®, SPARC®, or MIPS® ISAs, or any other suitable ISA. In multi-processor systems, each of processor(s) 510A-N may commonly, but not necessarily, implement the same ISA. Also, in some embodiments, at least one processor(s) 510A-N may be a graphics processing unit (GPU) or other dedicated graphics-rendering device.

System memory 520 may be configured to store program instructions and/or data accessible by processor(s) 510A-N. In various embodiments, system memory 520 may be implemented using any suitable memory technology, such as static random access memory (SRAM), synchronous dynamic RAM (SDRAM), nonvolatile/Flash-type memory, or any other type of memory. As illustrated, program instructions and data implementing certain operations, such as, for example, those described herein, may be stored within system memory 520 as program instructions 525 and data storage 535, respectively. In other embodiments, program instructions and/or data may be received, sent or stored upon different types of computer-accessible media or on similar media separate from system memory 520 or computing system 401. Generally speaking, a computer-accessible medium may include any tangible, non-transitory storage media or memory media such as magnetic or optical media—e.g., disk or CD/DVD-ROM coupled to computing system 401 via I/O interface 530.

The terms "tangible" and "non-transitory," are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

In an embodiment, I/O interface 530 may be configured to coordinate I/O traffic between processor 510, system memory 520, and any peripheral devices in the device, including network interface 540 or other peripheral interfaces, such as input/output devices 550. In some embodiments, I/O interface 530 may perform any necessary protocol, timing or other data transformations to convert data signals from one component (e.g., system memory 520) into a format suitable for use by another component (e.g., processor(s) 510A-N). In some embodiments, I/O interface 530 may include support for devices attached through various types of peripheral buses, such as a variant of the Peripheral Component Interconnect (PCI) bus standard or the Universal Serial Bus (USB) standard, for example. In some embodiments, the function of I/O interface 530 may be split into two or more separate components, such as a north bridge and a south bridge, for example. In addition, in some embodiments some or all of the functionality of I/O interface 530, such as an interface to system memory 520, may be incorporated directly into processor(s) 510A-N.

Network interface 540 may be configured to allow data to be exchanged between computing system 401 and other devices attached to network 115, such as other computer systems, or between nodes of computing system 401. In various embodiments, network interface 540 may support communication via wired or wireless general data networks, such as any suitable type of Ethernet network, for example; via telecommunications/telephony networks such as analog voice networks or digital fiber communications networks; via storage area networks such as Fiber Channel SANs, or via any other suitable type of network and/or protocol.

Input/output devices 550 may, in some embodiments, include one or more display terminals, keyboards, keypads, touch screens, scanning devices, voice or optical recognition devices, or any other devices suitable for entering or retrieving data by one or more computing system 401. Multiple input/output devices 550 may be present in computing system 401 or may be distributed on various nodes of computing system 401. In some embodiments, similar input/output devices may be separate from computing system 401 and may interact with one or more nodes of computing system 401 through a wired or wireless connection, such as over network interface 540.

As shown in FIG. 5, memory 520 may include program instructions 525, configured to implement certain embodiments described herein, and data storage 535, comprising various data accessible by program instructions 525. In an embodiment, program instructions 525 may include software elements of embodiments illustrated in FIG. 2. For example, program instructions 525 may be implemented in various embodiments using any desired programming language, scripting language, or combination of programming languages and/or scripting languages (e.g., C, C++, C#, JAVA®, JAVASCRIPT®, PERL®, etc.). Data storage 535 may include data that may be used in these embodiments. In other embodiments, other or different software elements and data may be included.

A person of ordinary skill in the art will appreciate that computing system 401 is merely illustrative and is not intended to limit the scope of the disclosure described herein. In particular, the computer system and devices may include any combination of hardware or software that can perform the indicated operations. In addition, the operations performed by the illustrated components may, in some embodiments, be performed by fewer components or distributed across additional components. Similarly, in other embodiments, the operations of some of the illustrated components may not be performed and/or other additional operations may be available. Accordingly, systems and methods described herein may be implemented or executed with other configurations.

Figure 6:
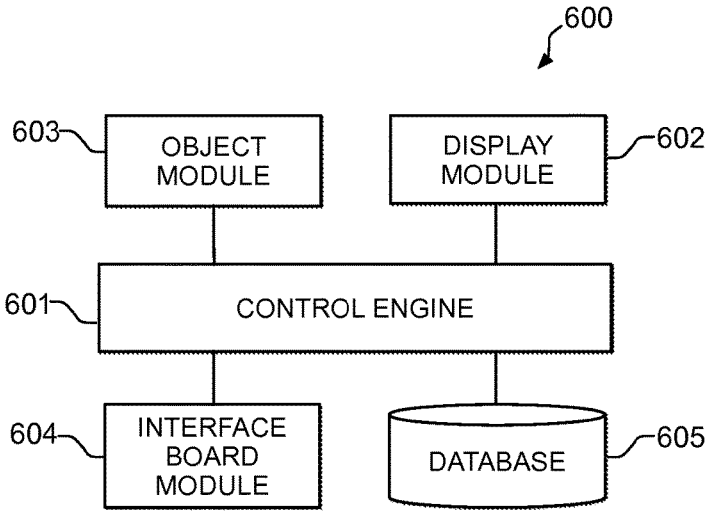
FIG. 6 is a block diagram of an example of a software program configured to implement aspects of a pinball machine with a hybrid playfield according to some embodiments.

FIG. 6 is a block diagram of an example of software program 600 configured to implement aspects of pinball machine 100 with a hybrid playfield 104. In some embodiments software 600 may be executed by computing system 401 described above. For example, in some cases, software program 600 may be implemented as program instructions 525 of FIG. 5. Generally speaking, control engine 601 may include one or more routines configured to implement one or more of the various techniques described herein. For instance, control engine 601 may include one or more routines configured to allow a user to select a game stored in database 605. Control engine 601 may also include one or more routines configured to allow a user to start or terminate a game, as well as one or more routines configured to manage progress of a game.

Display module 602 may provide a software interface between computing device 401 and electronic display 200 such that images produced by display module 602 are rendered in electronic display 200 under control of control engine 401. Interface board module 604 may provide a software interface between computing device 401 and interface board 402. Through interface board module 402, control engine 401 may determine that one or more sensor(s) 404 have been activated and/or it may control, via actuator(s) 403, a physical aspect of a physical object in hybrid playfield 104. Control engine 401 may also receive tracking information from tracking system 300 via interface board module 402.

Object module 603 may keep track of one or more graphical elements or virtual objects being displayed (or yet to be displayed) on electronic display 200 via display module 602, including, for example, a virtual object's characteristics such as the object's identification, boundaries, shape, color, size, texture, position (on electronic display 200), speed, direction of movement, etc. Object module 603 may also keep a record of the received tracking information for one or more physical objects including, for example, an identification of the physical object, its position (above electronic display 200), speed, direction of movement, shape, etc.

In some embodiments, the modules or blocks shown in FIG. 6 may represent processing circuitry and/or sets of software routines, logic functions, and/or data structures that, when executed by the processing circuitry, perform specified operations. Although these modules are shown as distinct logical blocks, in other embodiments at least some of the operations performed by these modules may be combined in to fewer blocks. For example, in some cases, object module 603 may be combined with display module 602 and/or with interface board module 604. Conversely, any given one of modules 601-605 may be implemented such that its operations are divided among two or more logical blocks. Although shown with a particular configuration, in other embodiments these various modules or blocks may be rearranged in other suitable ways.

FIG. 7 is a flowchart of an example of method 700 of operating tracking system 300 in hybrid playfield 104. In some embodiments, method 700 may be performed, at least in part, by computing system 401 executing software 600 in cooperation with interface board 402 and tracking system 300. At block 701, method 700 may include determining that a pinball game has started or is about to start. At block 702, method 700 may include identifying a transducer configuration to be used by tracking system 300. As previously noted, different transducer configurations may be used in a single machine 100, and, depending upon the specific game being played, a particular configuration may be more suitable for tracking certain physical objects.

At block 703, method 700 may include selecting a scanning pattern to be used during a tracking operation. For example, in the configuration shown in FIG. 3, the selected scanning pattern assigns detector elements 322, 324, 326, 328, and 330 to receive signals 318, 317, 314, 315, and 316 emitted by transmitter element 307, respectively. In some cases, a scanning pattern may be such that each of transmitter elements 301, 303, 305, 307, 309, 311, 313, 319, 321, 323, 325, 327, 329, and 331 is activated in rapid succession and in this order. In other cases, a transmitter element of first transducer array 300A may be activated followed by a transmitter element of second transducer array 300B in an alternating manner (e.g., 301, 319, 303, 321, and so on). In yet other cases, two or more transmitter elements may be activated simultaneously.

In some implementations, more or fewer detectors may be assigned to receive more or fewer signals from a given transmitter element at a given time. Moreover, the position of the transmitter element may dictate how many and which detector elements are assigned for a given scanning pattern. For instance, using the pattern illustrated in FIG. 3, when transmitter 301 is active, only detectors 320 and 322 (i.e., two detectors) may be configured to receive its signals. When transmitter 303 is active, detectors 320, 322, 324, and 326 (i.e., four detectors) may be configured to receive its signals. And, when transmitter 305 is active, detectors 320, 322, 324, 326, and 328 (i.e., five detectors) may be configured to receive its signals. In other implementations, however, a 1:1 relationship between transducer elements may be established such that a given detector is assigned to a single corresponding transmitter and vice-versa.

More generally, any suitable scanning pattern may be selected that creates a mesh such that, when a physical object such as pinball 202 is traveling between transducer arrays 300A and 300B therefore blocking the line-of-sight between a transmitter and an assigned detector, tracking system 300 and/or computing system 401 is capable of determining the position, speed, and/or direction of movement of the physical object. In various embodiments, signals are transmitted and received between transducer arrays 300A and 300B at angles other than a right angle.

At block 704, method 700 may execute scanning operation(s) using the identified configuration and/or selected pattern and, at block 705, method 700 may store results of those operation(s). At block 706, method 700 may determine whether the game has ended. If not, control returns to block 704. Otherwise, tracking may end at block 707.

It should be noted that, in some embodiments, one or more of the operations described above may be conducted independently of whether a game is in progress. For example, in some cases, tracking may be active for purposes of touchscreen interactions when pinball machine 100 is in "service mode" (e.g., testing, debugging, etc.). More generally, electronic display 200 in conjunction with tracking system 300 may allow an operator to interface with aspects of computing system 401 at any time, for instance, to change the machine's configuration, select a new pinball game, test one or more of the machine's components, etc.

FIG. 8 is a flowchart of an example of method 800 of obtaining an object's position in hybrid playfield 104 using tracking system 300 according to some embodiments. Again, in some embodiments, method 800 may be performed, at least in part, by computing system 401 executing software 600 in cooperation with interface board 402 and tracking system 300. At block 801, method 800 may include initializing or setting an integer or counter n to a zero value and, at block 802, method 800 may include activating transmitter element n.

At block 803, method 800 may include determining whether there is a direct line-of-sight reception at all of the one or more assigned detector elements. If so, then block 806 increments the value of n and control returns to block 802, where a subsequent transmitter element following the selected scanning pattern is selected. Otherwise, at block 804, method 800 may include identifying which of the assigned detector elements had its light-of-sight blocked by a physical object. Then, at block 805, method 800 may include calculating the physical object's position based, at least in part, upon the result of block 804.

To illustrate operations 802-806, consider the following example. Assume, hypothetically, that pinball 202 shown in FIG. 3 is now at a position such that it blocks the light-of-sight of detector 330 when transmitter 307 is activated. Because the relative position between arrays 300A and 300B is known, it may be inferred that, at the time of the scan, pinball 202 was located somewhere along the path of signal 316. As n is incremented, subsequent transmitter elements are activated and other detectors may have their light-of-sight blocked, such that the position of pinball 202 may be determined to be at the intersection(s) of two or more of these signals.

In some embodiments, the frequency of the scanning operation may be such that a sufficient number of transmitters are activated in series to resolve the position of pinball 202 prior to pinball 202 having moved to another position that is significantly distant from the resolved position. For example, in some cases, the position of pinball 202 may be identified with a margin of error no larger than the diameter of pinball 202.

Computing system 401, interface board 402, and/or object module 403 may also maintain a historical record of the positions of pinball 202 at different times. Therefore, computing system 401 and/or interface board 402 may be configured to calculate a speed of pinball 202 and/or a direction of movement of pinball 202 based on that historical record. In some cases, computing system 401 and/or interface board 402 may be further configured to predict the position of pinball 202 at a future time based upon its present and/or past behavior.

Physical Objects Causing Changes in Virtual Objects

In some embodiments, hybrid playfield 104 may provide the illusion that one or more physical objects, such as one or more balls 202, interact with one or more virtual objects, such as one or more images rendered on electronic display 200. This may take place, for example, when a physical object is detected via tracking system 300 to be moving over an area of hybrid playfield 104 containing the virtual objects. In other examples, the interaction with virtual objects may be triggered upon detection, via tracking system 300, that a physical object has a certain speed or moves in a particular direction (e.g., toward a virtual object) across hybrid playfield 104.

In some cases, interactions between a physical object and a first virtual object may cause that first virtual object to move, change its shape, disappear, etc. on electronic display 200. The same interactions between the physical object and the first virtual object may also cause a second virtual object to move, change its shape, appear, disappear, etc. on electronic display 200. Other game-related interactions resulting from the interaction of physical and virtual objects in hybrid playfield 104 may include, but are not limited to, game scores being adjusted, sound and video devices being played, lamps being turned on and off individually or in pre-defined sequences, etc.

Figure 9:
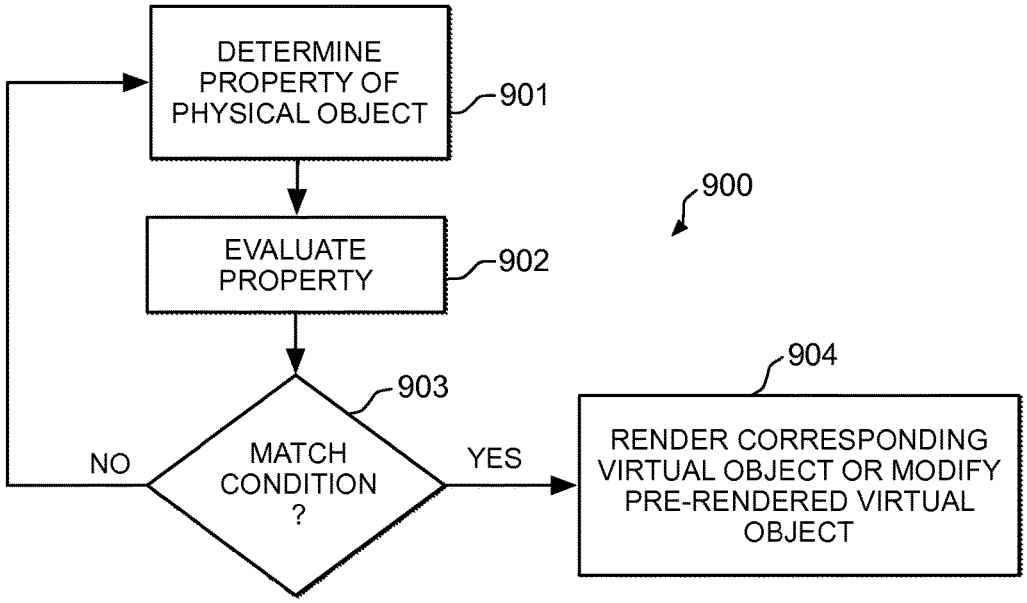
FIG. 9 is a flowchart of an example of a method of enabling physical object(s) to interact with virtual object(s) in a hybrid playfield according to some embodiments.

FIG. 9 is a flowchart of an example of a method of enabling physical object(s) to interact with virtual object(s) in hybrid playfield 104. In some embodiments, method 900 may be performed, at least in part, by computing system 401 executing software 600 in cooperation with electronic display 200, interface board 402, and tracking system 300. At block 901, method 900 may include determining a property of a physical object (e.g., pinball 202). For instance, in some cases, method 900 may include determining a position of the physical object on hybrid playfield 104, a speed of the physical object over hybrid playfield 104, and/or a direction of movement of the physical object across hybrid playfield 104.

At block 902, method 900 may evaluate the property. At block 903, if the property does not match any preselected conditions, control returns to block 901. Otherwise, control passes to block 904, where method 900 may include rendering a corresponding virtual object on display 200 or modifying a previously rendered virtual object. The conditions referred to in block 903 may include any programmable statement(s) that, when executed, give the appearance that the physical object's property or behavior has affected one or more virtual objects.

In some implementations, a player may indirectly manipulate the physical object described in block 901. For example, when the physical object is pinball 202, the player may briefly hit that object with another physical object, such as flippers 207A and 207B. Manipulation of flippers 207A and 207B may itself be indirect, for example, via side control(s) 107. After being hit, pinball 202 may travel along playfield freely and outside of the user's control.

It should be noted that determination of a property of a physical object in block 901 is different from the detection of a player's own finger or stylus on a capacitive touchscreen of a tablet computer, which the user directly controls. For example, in the tablet scenario, if the touchscreen does not respond as expected by the user, the user may simply repeat his or her gesture; whereas in the case of a pinball machine, because pinball 202 moves on its own, it would be much more difficult to make pinball 202 repeat the exact same trajectory at a later time and, in any event, a game opportunity would be lost.

Figure 10A:
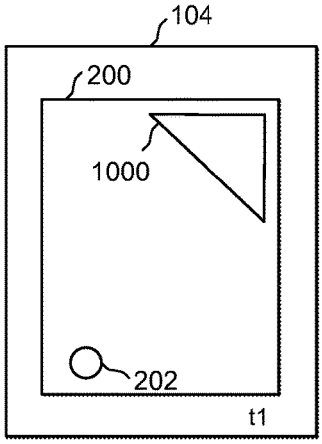
FIGS. 10A-H are diagrams illustrating examples of physical object(s) initiating interaction(s) with virtual object(s) according to some embodiments.
Figure 10B:
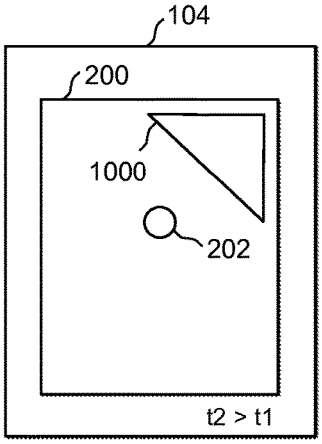
Figure 10C:
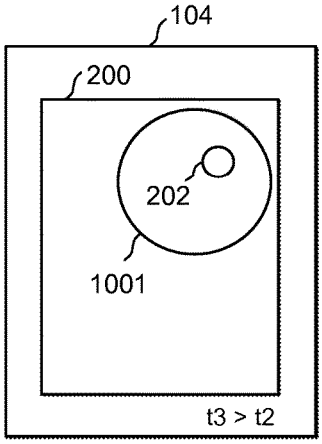

FIGS. 10A-H are diagrams illustrating examples of physical object(s) initiating interaction(s) with virtual object(s) according to some embodiments. Particularly, FIG. 10A shows pinball 202 (i.e., a physical object) at t=t1 traveling along hybrid playfield 104 while electronic display 200 renders virtual object 1000 in the shape of a triangle. At FIG. 10B, pinball 202 has moved closer to virtual object 1000 at t=t2 (t2>t1), but has not yet reached it. Then, at FIG. 10C, pinball 202 has reached the position of virtual object 1000 on electronic display 200 at t=t3 (t3>t2), thus causing virtual element 1000 to change into virtual element 1001, which now has a circular shape. Referring back to FIG. 9, the predetermined condition expressed in block 903 in this case may be such as:

if position of <pinball 202>==position of <virtual object 1000>;

then change <virtual object 1000> into <virtual object 1001>

Thus, in this case, the operations of method 900 may help create a visual impression that pinball 202 has physically interacted with virtual object 1000 upon reaching its location in hybrid playfield 104 and effectively changed the virtual object's shape and/or other visual characteristic.

Figure 10D:
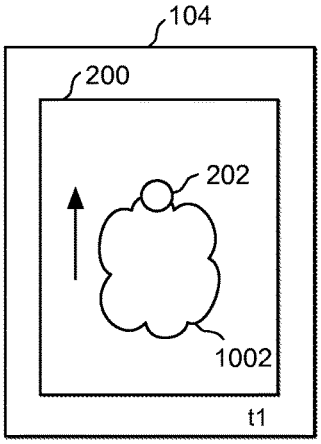
Figure 10E:
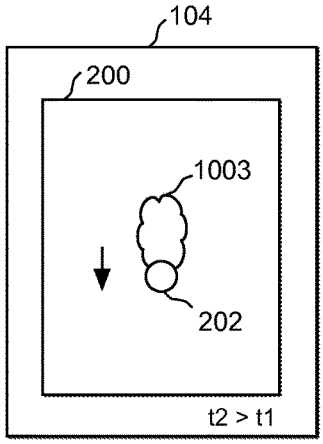

As another example, FIG. 10D illustrates pinball 202 traveling upwards (shown by an arrow pointing up) across hybrid playfield 104 at t=t1 (e.g., after being hit by flipper(s) 207A or 207B), thus acquiring a first speed. FIG. 10E shows pinball 202 traveling in a downwards direction (shown by an arrow pointing down) at t=t2 (t2>t1) with a second speed which, in this case, is smaller than the first speed. Accordingly, in FIG. 10D, virtual object 1002 represents a graphical image or visual animation of fire or smoke following pinball 202 and having a first size proportional to the first speed, whereas in FIG. 10E virtual object 1003 represents the fire or smoke with a second size proportional to the second speed, such that the first size is larger than the second size.

Figure 10F:
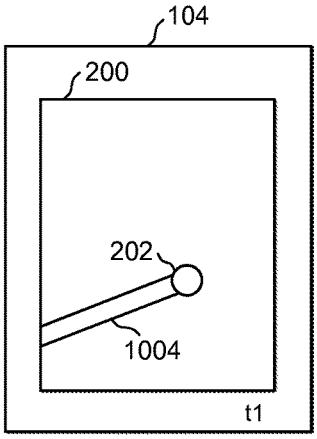
Figure 10G:
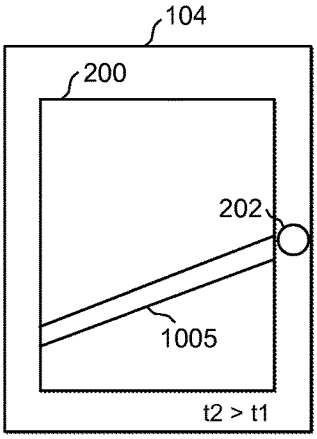
Figure 10H:
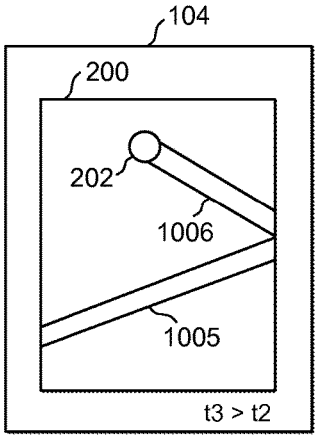

As yet another example, FIG. 10F shows pinball 202 traveling across hybrid playfield 104 at t=t1 in a first direction thus leaving trail or mark 1004. FIG. 10G shows pinball 202 leaving the surface of electronic display 200 and reaching the boundary of hybrid playfield 104 at t=t2 (t2>t1), from which pinball 202 bounces back. As such, trail or mark 1005 is longer than trail or mark 1004. Then, FIG. 10H shows pinball 202 traveling across hybrid playfield 104 in a second direction at t=t3 (t3>t2), thus creating trail or 1006 in the second direction.

It should be noted that the examples of FIGS. 10A-H are provided for sake of illustration. More generally, any virtual object(s) rendered on electronic display 200 may be affected by any physical property (or combination of physical properties) of any physical object(s) within hybrid playfield 104 in any suitable manner. In the examples above, the physical properties used are position, speed, and direction; although in other embodiments, other physical properties may be used such as shape, size, sound, color, etc. In various implementations, the type of virtual object and how that object is affected by the behavior of a physical object normally depends upon the specific game being played, and as such may vary from game to game.

Moreover, in some embodiments, the behavior of a physical object may be detected other than through tracking system 300. For instance, pinball 202 may physically reach trigger element 205, and electronic display 200 may in response render an animation such that it appears that a first virtual object such as an image of a laser beam or projectile is shot by trigger element 205 into hybrid playfield 104. The first virtual object may then interact with other virtual objects on electronic display 200; for example, the virtual laser beam or projectile may cause a second virtual object (e.g., an image of a building, etc.) to explode on electronic display 200.

Virtual Objects Causing Changes in Physical Objects

In some embodiments, hybrid playfield 104 may present the illusion that one or more virtual objects, such as one or more images rendered on electronic display 200, interact with one or more physical objects, for example, when the virtual object exhibits a predetermined behavior. For instance, when a virtual element is animated on display 200 in a particular way, it may trigger a software-initiated modification to an aspect of a physical object.

Figure 11:
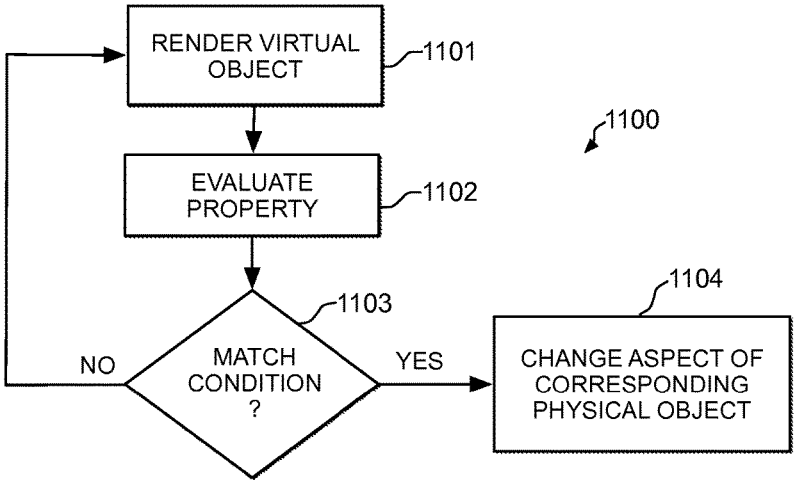
FIG. 11 is a flowchart of an example of a method of enabling virtual object(s) to interact with physical object(s) in a hybrid playfield according to some embodiments.

In that regard, FIG. 11 is a flowchart of an example of a method of enabling virtual object(s) to interact with physical object(s) in hybrid playfield 104. In some implementations, method 1100 may be performed, at least in part, by computing system 401 executing software 600 in cooperation with electronic display 200, interface board 402, and tracking system 300. At block 1101, method 1100 may include rendering a virtual object on electronic display 200. At block 1102, method 1100 may include evaluating a property of the virtual object. At block 1103, if the property does not match a programmed condition, control returns to block 1101. Otherwise, at block 1104, method 1100 may include changing an aspect of a corresponding physical object.

Figure 12A:
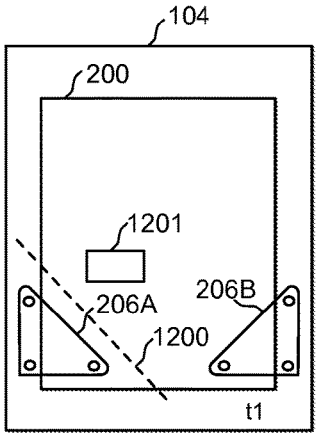
FIGS. 12A-F are diagrams illustrating examples of virtual object(s) initiating interaction(s) with physical object(s) according to some embodiments.
Figure 12B:
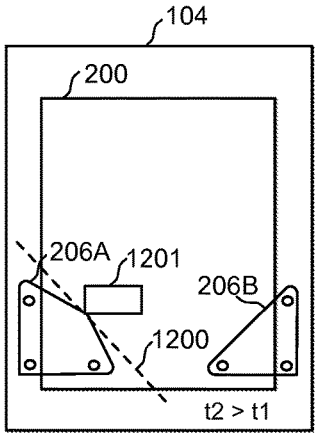
Figure 12C:
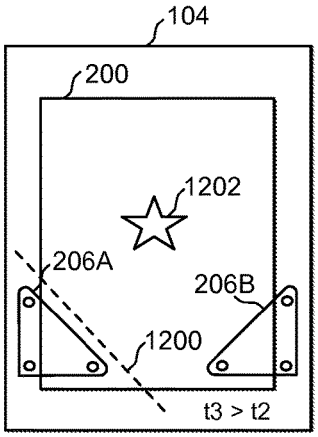

FIGS. 12A-F are diagrams illustrating examples of virtual object(s) initiating interaction(s) with physical object(s) according to some embodiments. In FIG. 12A, virtual object 1201 is animated on display 200 to move at t=t1 toward slingshot 206A, a physical object. FIG. 12B shows virtual object 1201 reaching threshold line 1200 at t=t2 (t2>t1), thus triggering a deformation of slingshot 206A such that, to an observer, it appears as if slingshot 206A is reacting physically to the behavior of virtual object 1201 on display 200. The deformation of slingshot 206A is a physical response initiated by software because, in this case, virtual object 1201 is in a specific position relative to slingshot 206A. In an embodiment, the shape of slingshot 206A may be controlled by a solenoid mechanism that, when activated by software, pushes against a side of slingshot 206A, thus causing it to mechanically expand. Then, FIG. 12C shows slingshot 206A returning to its original shape at t=t3 (t3>t2), and electronic display 200 changes the shape of virtual element 1201 into virtual element 1202, which now travels away from slingshot 206A on display 200 as if it had physically bounced off of slingshot 206A and now appears to be moving further away from slingshot 206A.

By drawing virtual element 1202 such that it appears to be moving away from slingshot 206A, this technique may cause observer, such as the player, to believe that a virtual element 1201 (i.e., a graphical image) actually represents a physical object that interacted mechanically or physically with another (but actual) physical object (i.e., slingshot 206A). More specifically, it may appear as if virtual element 1201 actually collided with slingshot 206A, causing a solenoid mechanism to activate, in turn causing slingshot 206A to "push" virtual element 1202 away from it.

Figure 12D:
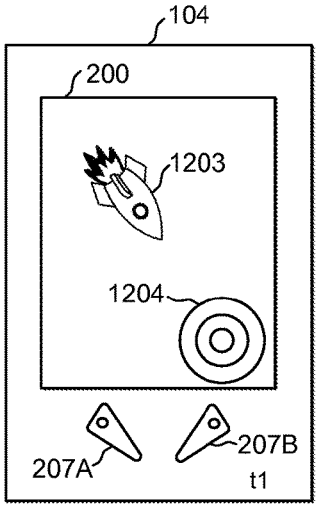
Figure 12E:
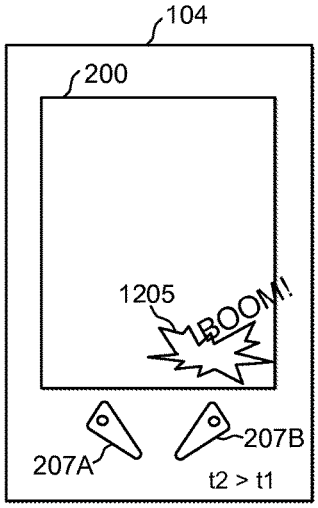
Figure 12F:
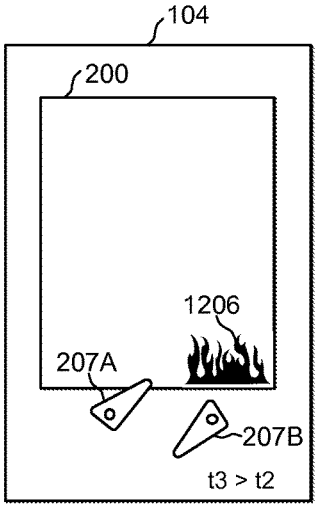

In other embodiments, a virtual element does not need to appear to come into contact with a physical object, but it may still affect the operation of that physical object. An example of this technique is shown in FIGS. 12D-E. In FIG. 12D, a first virtual object 1203 (a rendering of a missile) is animated to move toward a second virtual element 1204 (a rendering of a target) on electronic display 200 at t=t1. FIG. 12E shows that first virtual object 1203 and second virtual object 1204 have been replaced by third virtual object 1205 (a rendering of an explosion) upon first virtual object 1203's reaching of second virtual object 1204 at t=t2 (t2>t1). At this moment, operation of flipper 207B (i.e., a physical object) may be changed such that, when a player activates side control(s) 107, only flipper 207A is capable of moving upwards while flipper 207B is stuck in a down position as a result of the collision between virtual element 1203 and virtual element 1204. In some cases, a fourth virtual object 1206 (e.g., a rendering of fire or smoke) may indicate that flipper 207B is not operational such that, when virtual object 1206 disappears of fades from electronic display 200, flipper 207B returns to its normal operation under control of the player.

In other words, when the first virtual object reaches a specific point on electronic display 200, it may cause a specific, predetermined reaction in a physical object, such as one or more flippers 207A and 207B. An example of such a reaction may be to cause the one or more of flippers 207A and 207B to flip, as if the missile pressed a "virtual flipper" button. Another reaction may be causing flippers 207A and 207B to "lose power," such that when the player next activates the flippers, they do not have as strong a pulse as they did prior to the missile reaching the specific location on electronic display 200. Because the length of the flipper pulse, and therefore the power of the pulse, is controlled by software, control engine 601 may effectively weaken flippers 207A and/or 207B in response to missile 1203 reaching the specific location on the electronic display 200. This technique may make it appear that the graphical, virtual object (i.e., missile 1203) represented a physical element, such as a real missile, and was therefore capable of affecting physical object (i.e., flippers 207A and 207B).

Similarly as explained above, here it should also be noted that the examples of FIGS. 12A-F are provided for sake of illustration. More generally, any physical object(s) in hybrid playfield 104 may have its propert(ies) modified in response to the behavior of one or more virtual object(s). Properties of the physical objects that may be subject to being changed include its shape, operation, color, sound, etc. Again, in various implementations, the type of physical object and how that object is affected by the behavior of a virtual object normally depends upon the specific game being played, and as such may vary from game to game.

Physical objects that can be affected by virtual objects include, but are not limited to, lamps, light emitting diodes (LEDs), magnets, motors, and solenoid assemblies, all of which may be found on pinball machine 100. Virtual objects that may interact with physical objects include, but are not limited to, shapes or combination of shapes drawn on a display element, projected from a projection device, or otherwise displayed in a way that they appear to be part of or on pinball machine 100. The location of virtual objects can be anywhere on machine 100, oftentimes, but not always, close to the physical objects with which they appear to interact. In the example above where the missile is described to press a virtual flipper button, the spatial proximity of the missile and virtual button relative to the flippers is not relevant. As such, the graphical elements (missile and virtual button) can be located anywhere on electronic display 200.

Deploying Physical Objects

In some embodiments, one or more of the aforementioned physical objects such as, for example, ball(s), plunger(s), bumper(s), kicker(s), bullseye target(s), drop target(s), variable point target(s), roll(s), saucer(s), spinner(s), rollover(s), switch(es), gate(s), stopper(s), ramp(s), toy(s), electromagnet(s), etc., or other physical objects, may be located in pinball machine 100. At least in part due to the presence of electronic display 200, tracking system 300, and/or other components, one or more of these physical objects may be deployed within hybrid playfield 104 as described in more detail below.

There are many places in a pinball machine where the systems and methods described herein may be used. Common situations involve places where there is not enough room for all of the components required to strike and apply an acceleration to other objects. In such cases, the components may be separated into connected components, one or more components being remotely located with respect to another component(s), two or more components connected to each other or linked in a suitable manner.

Figure 13:
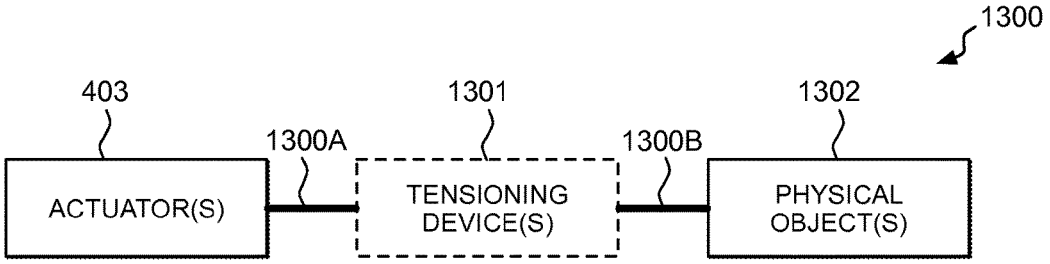
FIG. 13 is a block diagram of an example of a remote actuator system according to some embodiments.

In that regard, FIG. 13 is a block diagram of an example of a remote actuator system according to some embodiments. As illustrated, one or more actuator(s) 403 are operably coupled to one or more physical object(s) 1302 via one or more links. Particularly, in this example, link portion 1300A couples actuator(s) 403 to tensioning device(s) 1301, and link portion 1300B couples tensioning device(s) 1301 to physical object(s) 1302. It should be noted, however, that link portions 1300A and 1300B may in fact constitute a single, continuous link (collectively referred to as "link") and that, in some cases, tensioning device(s) 1301 may be absent. Tensioning device(s) 1301, when present, may be located somewhere along the link.

Generally speaking, movement of actuator(s) 403 creates a force applied to physical object(s) 1302 via the link. Particularly, link portions 1300A and 1300B coupled between actuator(s) 403 and physical object(s) 1302 ensure that the movement of actuator(s) 403, or component(s) within actuator(s) 403, is translated into the movement of physical object(s) 1302.

In some implementations, actuator(s) 403 may include an electric motor, plunger, or the like having a coil or solenoid element. When actuator(s) 403 (or one or more components within actuator(s) 403) moves, link portions 1300A and 1300B also move. The movement of link portions 1300A and 1300B cause physical object(s) 1302 to move as well. In some implementations, the specific nature of the movement of actuator(s) 403 and physical object(s) 1302 may be to cause physical object(s) 1302 to strike and apply an accelerating force to another physical object (e.g., pinball 202) in the pinball machine.

In some embodiments, tensioning device 1301 may be used to adjust the position and/or movement of physical object(s) 1302. For example, tensioning device may include a knob and a bracket or mount such that the link goes through both the knob and the bracket or mount. The bracket or mount may be coupled to a portion of the pinball machine to keep the knob from moving when a force is applied by actuator(s) 403 to the link, whereas the knob may increase the tension on the link when turned in one direction, and it may decrease the tension on the link when turned in the other direction. In other implementations, tensioning device 1301 may include a turnbuckle, a ratcheting device, or another suitable tensioning mechanism.

Link portions 1300A and 1300B may be used to translate the movement of actuator(s) 403, or component(s) of actuator(s) 403, into the movement of physical object(s) 1302 and may be made of any suitable material that is easy to bend and reshape, for example, at room temperature. The shapes of link portions 1300A and 1300B may also be dynamically adjusted when a force is applied to it by the movement of actuator(s) 403.

In some implementations, the material used for link portions 1300A and/or 1300B may include a flexible material that is readily capable of assuming various curved or bent configurations or paths within hybrid playfield 104, such as wire, rope, malleable steel cable, etc. For instance, link portions 1300A and 1300B may assume different configurations (e.g., bend around different points along their lengths) during the course of a pinball game as actuator(s) 403 and/or physical object(s) 1302 are operated. In other implementations, the material used for link portions 1300A and/or 1300B may be include a rigid material such as a steel rod, metal bar or arm, hard plastic (e.g., thermosetting plastics, etc.), or the like.

The lengths of link portions 1300A and 1300B may be determined by the positions at which actuator(s) 403 and physical object(s) 1302 are placed, as well as the path that the link needs to take to connect to actuator(s) 403 and physical object(s) 1302. For instance, when actuator(s) 403 are located in close proximity to physical object(s) 1302, the link may be short. Conversely, when actuator(s) 403 are located far away from physical object(s) 1302, the link may be long. As such, through the use of link portions 1300A and 1300B, actuator(s) 403 and physical object(s) 1302 may be located anywhere in the pinball machine, even large distances apart from each other.

In some embodiments, a housing or pipe may be used to provide a more rigid and consistent guide for the link's movement. Such housing may be a hollow tube or other material through which link portions 1300A and/or 1300B is routed. Further, the housing may be mounted in a way that it does not move relative to the pinball machine when actuator(s) 403 (and therefore the link) moves. Rather, link portions 1300A and/or 1300B move through it. Therefore, in some implementations, a cable housing may provide a well-defined and unchanging path that the link may follow when translating the movement of actuator(s) 403 to the movement of physical object(s) 1302.

Figure 14:
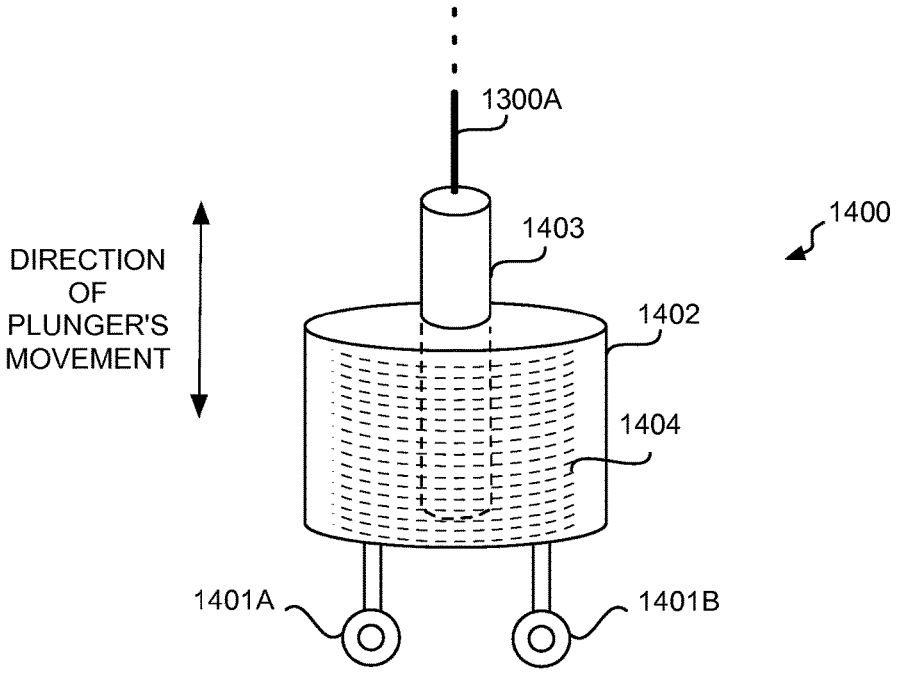
FIG. 14 is a three-dimensional diagram of an example of a single actuator according to some embodiments.

FIG. 14 shows a diagram of an example of a single actuator 1400. In some embodiments, single actuator 1400 may be used as actuator(s) 403 in FIG. 13. In this illustration, single actuator 1400 includes of one or more components that may be made to move in order to exert a force on link portions 1300A and/or 1300B. Particularly, casing 1402 includes electromagnet solenoid 1404 made up of a wire coupled to terminal 1401A, the solenoid being wrapped dozens or hundreds of times around a hollow core, and then coupled to another terminal 1401B. When a predetermined voltage is applied across terminals 1401A and 1401B, electrical current flows through solenoid 1404, thus creating a magnetic field inside the core around which the wire is wrapped. When the magnetic field is active, metal plunger 1403 is pulled into casing 1402 (a "first direction").

Link portion 1300A is coupled to plunger 1403 such that, when plunger 1403 is pulled in the first direction, link portions 1300A and/or 1300B are pulled along with it. Therefore, the movement of plunger 1403 translates into the movement of link portions 1300A and/or 1300B, and that movement translates into the movement of physical object(s) 1302. When the magnetic field is inactive—i.e., when no voltage is applied across terminals 1401A and 1401B—the force applied to plunger 1403, and therefore link portions 1300A and/or 1300B, disappears. In some cases, plunger 1403 may then move in a direction opposite to the first direction (a "second direction") to return to its original position. To move plunger 1403 back to its original position, a spring may be employed as described below. Additionally or alternatively, if physical object(s) 1302 is pushing against another component with some tension (e.g., a rubber ring), that component may exert a force back on physical object(s) 1302, thereby moving it back to its original position, and, by extension, forcing plunger 1403 back to its original position as well.

In some embodiments, a spring may be placed within casing 1402 to help return plunger 1403 to its original position outside of the solenoid's core. Such a spring may be compressed when plunger 1403 is pulled into casing 1402, and its subsequent decompression may force plunger 1403 back out of casing 1402. The force applied to plunger 1403 by the spring may be in the second direction. Accordingly, when the magnetic field within casing 1402 ceases, link portion 1300A moves outwardly from casing 1402, thus causing physical object(s) 1302 to also move in the second direction.

Figure 15:
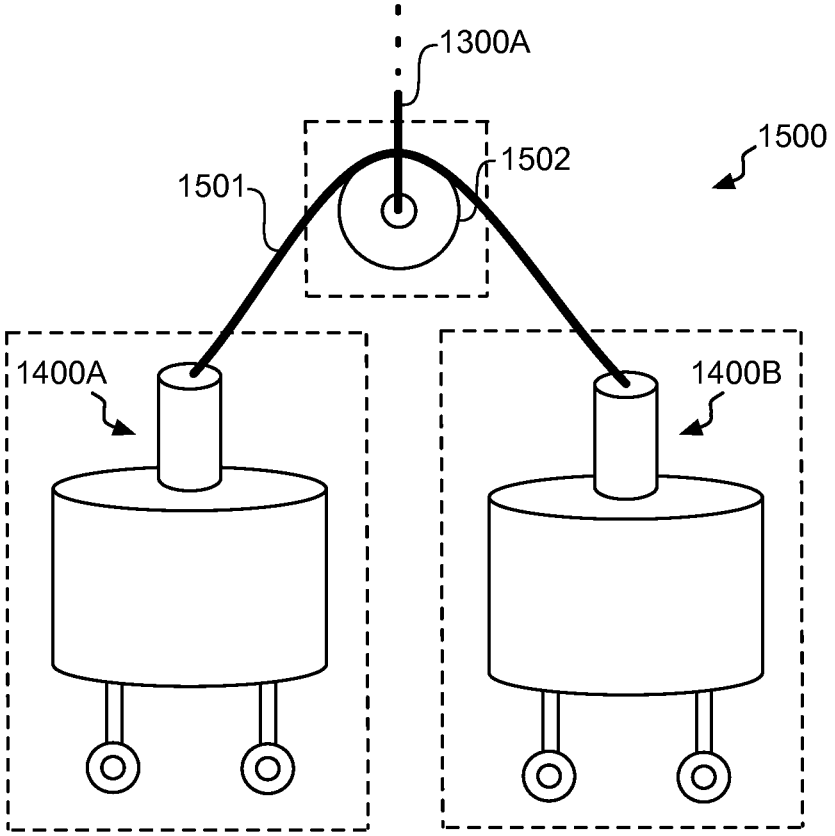
FIG. 15 is a three-dimensional diagram of an example of a dual actuator according to some embodiments.

FIG. 15 is a diagram of an example of a dual actuator 1500 according to some embodiments. In this illustration, two single actuators 1400A and 1400B may make up actuator(s) 403 of FIG. 13. More generally, however, any number N of single actuators may be used. Here actuators 1400A and 1400B are connected together by cable 1501, which is distinct from link portions 1300A and 1300B of FIG. 13. Cable 1501 is routed through pulley 1502, which is in turn coupled to link portion 1300A.

Similarly as before, link portions 1300A and/or 1300B couple actuator(s) 403 to physical object(s) 1302, and are therefore configured to translate movement between actuators 1400A/B and physical object(s) 1302. More specifically, when either of actuators 1400A and 1400B's plungers is pulled into its respective solenoid core, pulley 1502 is also pulled closer to respective one(s) of actuator(s) 1400A and/or 1400B. This movement of pulley 1502 exerts a force on link portion 1300A, and that force translates to movement of link portions 1300A and 1300B, and therefore movement of physical object(s) 1302.

In some embodiments, either or both of actuators 1400A and 1400B may be activated at any given time. Activating actuators 1400A and 1400B may simultaneously translate into more movement of pulley 1502 than when only one of actuators 1400A or 1400B is activated at a time. A larger movement of pulley 1502 translates into more movement of the link, and therefore faster movement of physical object(s) 1302. Accordingly, in some implementations, the use of N actuators may enable different lengths and/or speeds of movement in physical object(s) 1302.

Figure 16:
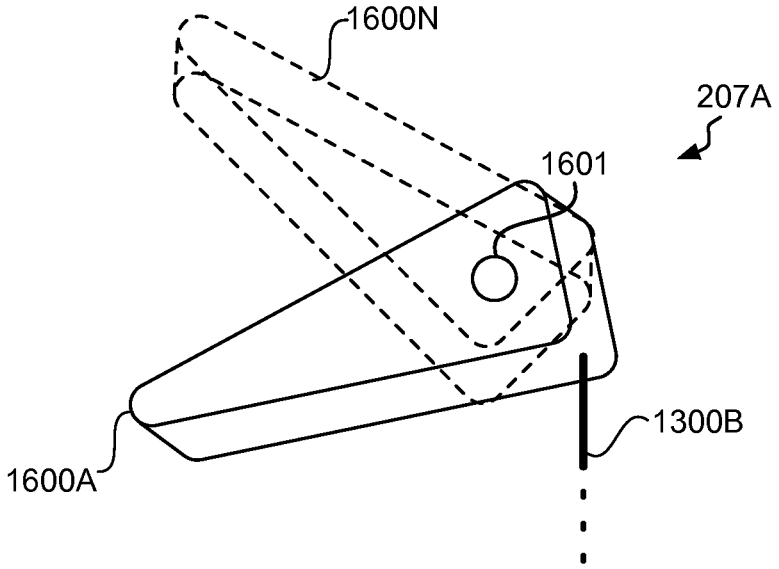
FIG. 16 is a three-dimensional diagram of an example of a remotely actuated flipper according to some embodiments.

FIG. 16 is a diagram of an example of a remotely actuated flipper 207A. In some embodiments, flipper 207A may be used as physical object(s) 1302 of FIG. 13. Here, flipper 207A pivots or rotates around point or post 1601 to assume one of two or more positions 1600A-N (or any other position in between) depending upon the force applied by link portion 1300B, which in turn depends upon the operation of actuator(s) 403, also shown in FIG. 13.

In some embodiments, post 1601 may be used to mount flipper 207A to a portion of hybrid playfield 104 that does not move when flipper 207A rotates around post 1601. This mounting can include, for example, a metal cylinder connected to a surface of pinball machine 101. In some cases, flipper 207A may be made of a single material, such as plastic, wood, metal, or any other suitable material. In other embodiments, however, flipper 207A may include multiple components and/or multiple materials. For example, flipper 207A may have a plastic body with a ball bearing mounted such that it fits around post 1601.

Here, link portion 1300B is coupled to a portion of flipper 207A other than post 1601 (that is, the actual flipper bat) and in such a way that movement of link portion 1300B translates to flipper 207A rotating around post 1601. When link portion 1300B moves towards the bottom of FIG. 16, flipper 207A rotates clockwise, potentially reaching position 1600N or any other intermediate position. When link portion 1300B moves towards the top of FIG. 16, flipper 207A rotates counterclockwise, potentially returning to position 1600A.

In some implementations, flipper 207A may be controlled by a user operating side control(s) 107 to strike and/or apply an acceleration to another object, such as pinball 202. The acceleration may be applied to pinball 202 directly or indirectly (e.g., in cases where flipper 207A is surrounded by a rubber ring or the like; in which case, the rubber ring applies the force to pinball 202). For example, if pinball 202 is at a location where part of flipper 207A resides when traveling between positions 1600A and 1600N, flipper 207A may strike pinball 202 and therefore apply an acceleration to it by rotating around post 1601 due to the movement of link portion 1300B.

Figure 17:
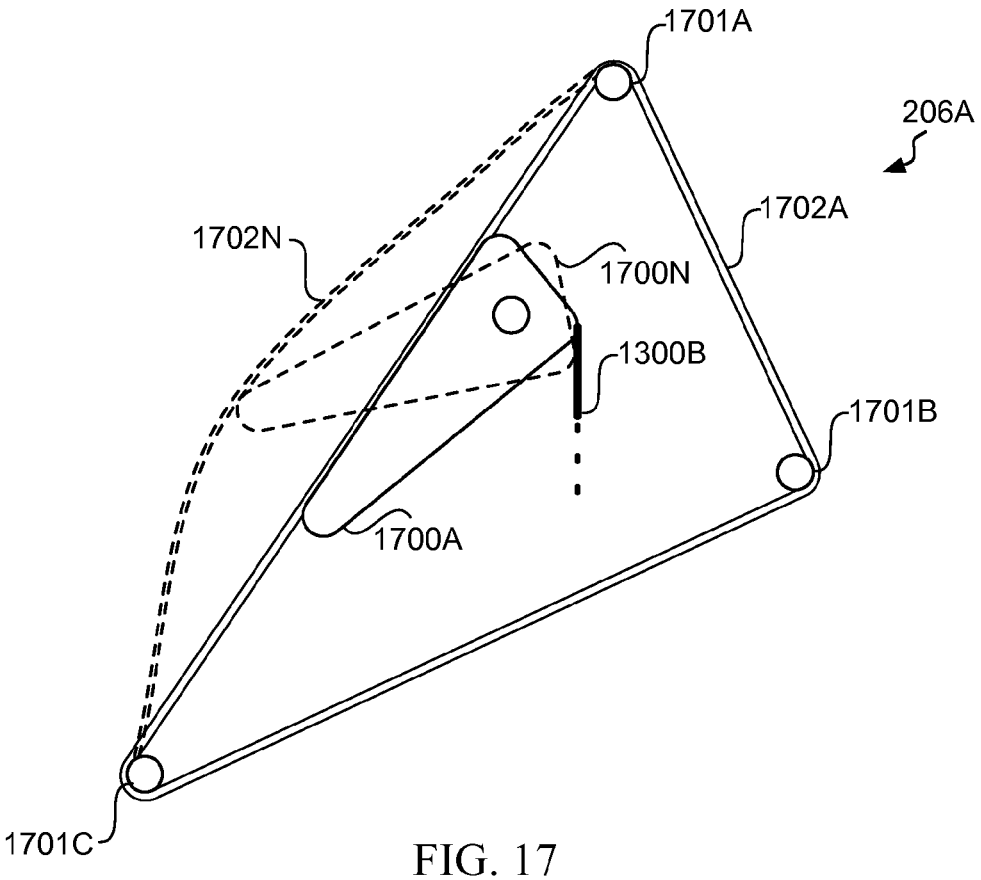
FIG. 17 is a top-view diagram of an example of a remotely actuated slingshot according to some embodiments.

FIG. 17 is a diagram of an example of remotely actuated slingshot 206A. In some embodiments, posts 1701A-C hold rubber ring 1702A or the like in place, and bat 1700A (similar to flipper 207A shown in FIG. 16) may be configured to push against ring 1702A. In that scenario, bat 1700A may be configured to rotate as described in connection with FIG. 16 to assume position 1700N (or any position in between), in which case rubber ring 1702A may assume shape 1702N (or any shape in between). Thus, rubber ring 1702N may strike pinball 202 upon control of actuator(s) 403 shown in FIG. 13.

Particularly, when actuator(s) 403 pull link portions 1300A and/or 1300B, bat 1700A may move to position 1700N, thus causing ring 1702A to assume configuration 1702N. Therefore, if pinball 202 meets the rubber ring while the rubber ring is traveling between positions 1702A and 1702N, slingshot 206A may strike pinball 202 and therefore apply an acceleration to it. Then, when actuator(s) 403 stop pulling link portions 1300A and/or 1300B, bat 1700N returns to its original position 1700A.

As described, FIGS. 16 and 17 present embodiments of physical object(s) 1302 of FIG. 13. It should be noted, however, that these embodiments are shown only by way of illustration, and that numerous other embodiments and variations are contemplated. In some cases, physical object(s) 1302 may move in a single direction, whether along a straight line or around a point. In other cases, physical object(s) 1302 may move in multiple directions, sometimes simultaneously, and other times only one direction at a time. It should also be noted that movement of physical object(s) 1302 is often, but not always, intended to strike and apply an acceleration to another object (e.g., pinball 202).

In some implementations, physical object(s) 1302 may contain one or more springs or other tensioning devices to help apply movement to component(s) coupled to link portions 1300A and/or 1300B. For example, in FIGS. 16 and 17, a spring may be added to help return flipper 207A and/or slingshot 206A to its original position once the force being exerted by link portions 1300A and/or 1300B goes away. The force therefore being applied by the spring may subsequently cause flipper 207A and/or slingshot 206A to exert a force on link portions 1300A and/or 1300B, which translates to a force on components actuator(s) 403. In this manner, the system may be reversed in that physical object(s) 1302 now act to provide a force on link portions 1300A and/or 1300B in order to produce movement in actuator(s) 403. However, components of actuator 403 may not necessarily be moved in order to strike and apply an acceleration to another object. In various embodiments, the movements caused in actuator(s) 403 by the movements of physical object(s) 1302 are to return components within actuator(s) 403 to their original positions.

Generally speaking, it should be noted that components within actuator(s) 403 or components within physical object(s) 1302 need not be located in the same general vicinity or be directly attached to each other. In other words, actuator(s) 403 and physical object(s) 1302 may be made up of many components that are located far apart from each other.

Furthermore, in some embodiments, one or more physical object(s) 1302 may be deployed within hybrid playfield 104. As such, the presence of electronic display 202 and/or tracking system 300 may prevent physical object(s) 1302 from being directly coupled to the playing surface of playfield 104. To address these and other concerns, FIGS. 18-20 describe systems and methods of suspending or floating physical object(s) 1302 within hybrid playfield 104.

Figure 18:
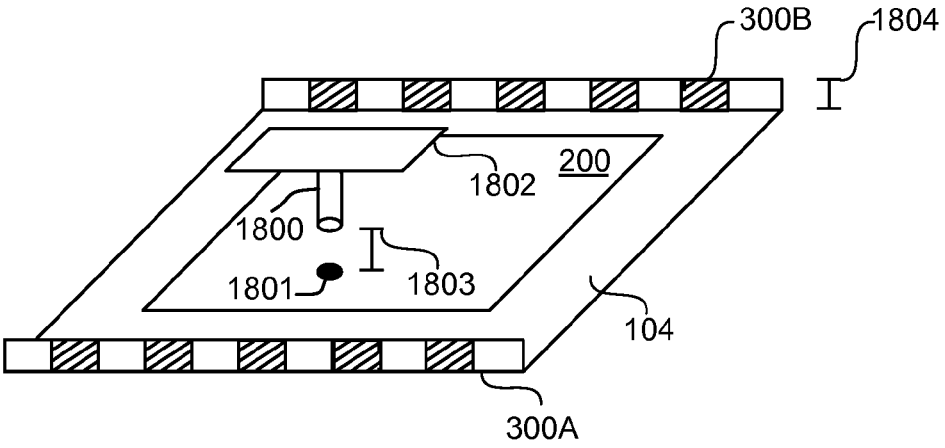
FIG. 18 is a three-dimensional, auxiliary view of an example of a suspended physical object in a hybrid playfield according to some embodiments.

In that regard, FIG. 18 is a diagram of an example of a suspended or floating physical object 1800 in hybrid playfield 104 according to some embodiments. Specifically, object 1800 may be a metal post used to prevent pinball 202 from traveling into a part of playfield 104 that is blocked by object 1800. In some cases, object 1800 may include a rubber ring or the like. In order to keep the assembly from moving or breaking when pinball 202 hits it, traditional mounting techniques would involve screwing directly into playfield 104 or screwing into a nut located underneath playfield 104; thus causing object 1800 to appear to rise up from playfield 104.

In contrast, here object 1800 is suspended within playfield 104 above electronic display 200, thus appearing to be floating above the surface of playfield 104. Particularly, object 1800 is mounted onto surface 1802, which in this case may be a portion of a playfield cover or some other non-playable area, and hangs down from surface 1802. Point 1801 indicates the location of playfield 104 where object 1800 would touch electronic display 200 were it long enough to do so; and gap 1803 illustrates the distance between the tip of object 1800 and point 1801.

There may be a number of reasons why one may want object 1800 to appear as if it were floating in a pinball machine. For example, it may not be possible to mount the assembly in the desired location on playfield 104. In FIG. 18, for instance, electronic display 200 makes it impossible to mount object 1800 assembly in the desired location on playfield 104. In other cases, components other than an electronic display may block object 1800.

Also, one may wish to allow certain items to pass below the assembly, closer to the surface of playfield 104. Still referring to FIG. 18, tracking system components 300A and 300B may include transmitters and receivers that transmit and receive beams of light, for example, as described in FIG. 3. Thus, the height 1804 of components 300A and 300B may be smaller than the gap 1803 between object 1800 and point 1801 so as to allow components 300A and 300B to communicate with each other while still blocking pinball 202 from entering a specific part of playfield 104 (e.g., the diameter of pinball 202 may be greater than gap 1803). In contrast, if object 1800 had been mounted directly on the surface of playfield 104, object 1800 would at least partially block communications between components 300A and 300B, thus creating a blind spot around which tracking system 300 would be unable to track the movement of pinball 202.

There are a number of ways to mount floating pinball assemblies to provide the illusion that objects or assemblies are floating, for example, by keeping surface 1802 out of view from the player's perspective. In that regard, FIGS. 19A-C are diagrams of components configured to suspend object 1901 in hybrid playfield 104 according to some embodiments.

Figure 19A:
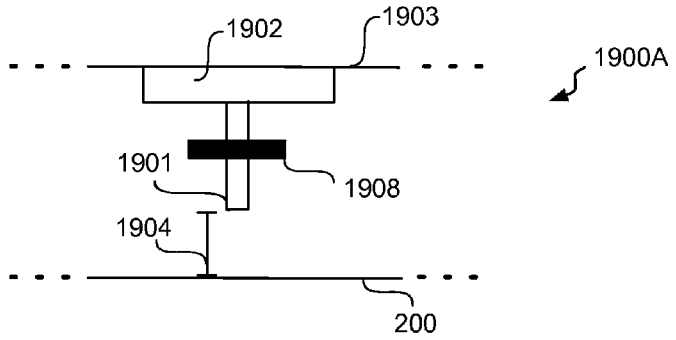
FIGS. 19A-C are side-view diagrams of components configured to suspend a physical object in a hybrid playfield according to some embodiments.
Figure 19B:
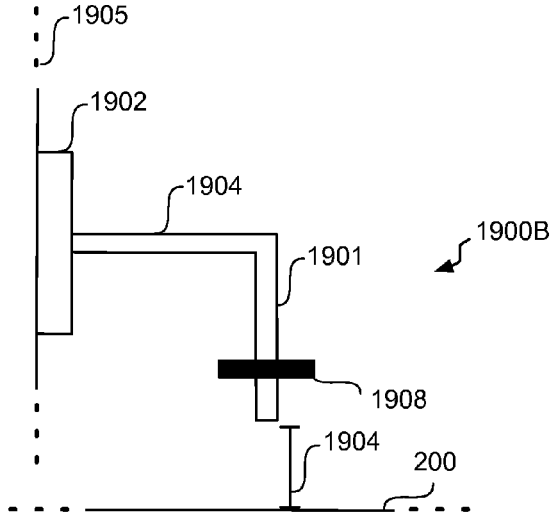
Figure 19C:
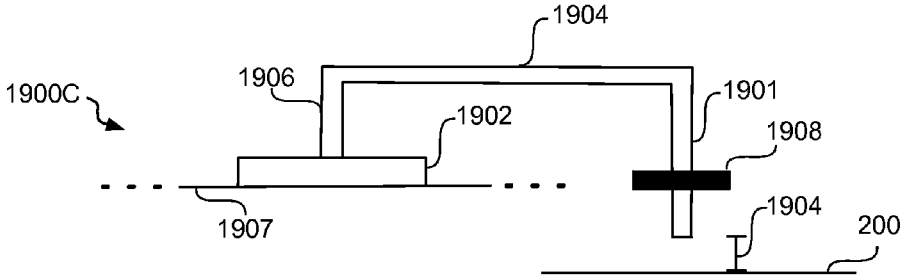

In example 1900A of FIG. 19A, mount 1902 holds object 1901 having rubber ring 1908 above electronic screen 200 with gap 1904. Mount 1902 may be attached to cover 1903. In some cases, at least mount 1902 and/or cover 1903 may be made of glass, plastic, LEXAN, PLEXIGLAS, acrylic or other transparent or translucent materials so as to give the impression that object 1902 is floating. As to example 1900B of FIG. 19B, mount 1902 is vertically positioned and mounted against side wall 1905 of pinball machine cabinet 101. Thus, arm 1904 may extend horizontally away from side wall 1905 to object 1901. In some cases, at least mount 1902, side wall 1905, and/or arm 1904 may be made of glass, plastic, LEXAN, PLEXIGLAS, acrylic or other transparent or translucent materials. With respect to example 1900C of FIG. 19C, mount 1902 is horizontally positioned and mounted against horizontal surface 1907 of the pinball machine distant from electronic display 200, out of sight from the player's perspective. Thus, vertical arm 1906 is coupled to horizontal arm 1904, which in turn is coupled to object 1901. Again, at least mount 1902, vertical arm 1906, and/or horizontal arm 1904 may be made of glass, plastic, LEXAN, PLEXIGLAS, acrylic or other transparent or translucent materials.

It should be noted that, in the foregoing examples, the assembly that includes object 1901 and ring 1908 (i.e., the object(s) with which pinball 202 makes contact) are directly coupled to non-playable surfaces of the pinball machine (e.g., side wall 1905, etc.), that is, surfaces other than the playable surfaces that are accessible to pinball 202 during the normal course of a pinball game, and where the pinball game is actually played (e.g., including a surface immediately above electronic display 200). Moreover, the mounting is done in such a way that the items in the assembly appear to be hanging or floating from the player's perspective. In some cases, object 1901 may itself be made of glass, plastic, LEXAN, acrylic or other transparent or translucent materials, thus giving the impression that ring 1908 is floating.

Floating assemblies may have few items, such as posts and rubber rings, or may be very complex with numerous items, including combinations of fixed and moving parts. For example, flipper 207A may be made into a floating assembly by inverting the typical installation and mounting it from above, similar to how the post 1901 is mounted in FIGS. 18 and 19A. Slingshot assembly 206A may also be suspended or mounted from above.

Figure 20:
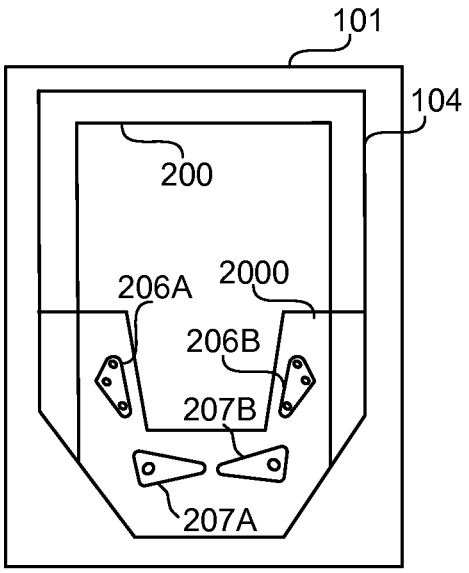
FIG. 20 is a top-view diagram of an example of a surface configured to suspend physical objects in a hybrid playfield according to some embodiments.

FIG. 20 is a diagram of an example of intermediate surface 2000 configured to suspend physical objects in hybrid playfield 104 according to some embodiments. Particularly, flippers 207A and 207B, as well as slingshots 206A and 206B, are mounted on intermediate surface 2000, which may be located at an intermediary height between a cover or lid of the machine, and the playable surface of playfield 104. In some embodiments, components of flippers 207A/B and/or of slingshot posts 206A/B, as well as intermediate surface 2000, may be made of transparent or translucent materials. Intermediate surface 2000 may also hang over the playable surface of playfield 104, anchored to either the side of pinball machine cabinet 101 or to other items out of view from the player.

In the example of FIG. 20, electronic display 200 is embedded into playfield 104 directly below assemblies 206A/B and/or 207A/B. Because traditional non-floating assemblies 206A/B and/or 207A/B would need to be mounted directly to playfield 104, having electronic display 200 in the playfield makes it impractical to use the traditional non-floating assemblies. Floating assemblies 206A/B and/or 207A/B provide similar characteristics to non-floating ones, but are mounted in a way that does not interfere with electronic display 200. Further, by making most of the items in the assembly out of acrylic, or other transparent or semi-transparent material, the player can still see graphics and other items being displayed on electronic display 200, even directly under the floating assemblies 206A/B and/or 207A/B.

Another embodiment may contain some or all of the following items floating near one or both sides of playfield 104: posts, rings, switch targets, guide rails, and other items otherwise used in pinball machines. Once again, a floating assembly with these items may be used due to the inability to mount the items directly to playfield 104, such as in the case of the playfield containing electronic display 200 or other items. It might also be used so that they do not obstruct the path of infrared beams going across the playfield, near the playable surface of playfield 104. Such infrared beams may be used to detect the position of pinball 202 as it moves across the surface of playfield 104. Using traditional non-floating assemblies mounted into the playfield itself would not work, because assemblies would block infrared beams, rendering the tracking system at least partially useless.

In summary, floating pinball assemblies may generally operate as their non-floating pinball counterparts, but they present the illusion, from the player's perspective, that they are floating above the playable surface of playfield 104 or above other items mounted to the playfield. They therefore enable the use of features that would not otherwise be usable in a pinball machine, such as electronic display 200 embedded into playfield 104 in areas that are typically used for assembly mounting, or tracking systems whose infrared beams need to travel through areas generally populated by traditional non-floating assemblies.

Animated Playfield Components

Flippers, slingshots, targets, and other physical objects may be used as playfield components configured to physically interact with a pinball during a pinball game. For instance, referring to FIG. 2, playfield components such as flippers 207A/B, slingshots 206A/B, and targets 205 may be disposed within playfield 104 and may be used to perform different gameplay operations. Although some of the examples of animated playfield components discussed below refer specifically to flippers, it should be understood that the same principles may be applied to any other of the aforementioned physical objects and components.

Generally speaking, flippers 207A/B may be manipulated by a player in order to prevent pinball 205 from falling in drain 208, and/or to otherwise control pinball 205. Flipper manipulation may be achieved via software, direct hardware wiring, etc. Usually, but not always, pinball machines have two flippers near the bottom of the playfield, as shown in FIG. 2. Certain machines may have fewer flippers. Other machines have additional flippers in other areas of playfield 104 to give players the ability to control pinball 202 at other locations of the playfield.

As noted in connection with FIG. 16, a flipper may pivot or rotate around a point or post to assume one of two or more predetermined positions under control or a player. When flippers are activated, typically by the player hitting a button (e.g., side control 107 in FIG. 1) corresponding to the flipper, the flipper rotates into another position. The changing of the flipper's position may be used to redirect the motion of a pinball. Flippers may also be used for other gameplay operations. Examples include, but are not limited to, holding a pinball in place, allowing a pinball to bounce from one flipper to another, and stopping the motion of a pinball.

Conventional flippers are typically made out of plastic, and they are usually opaque and single-colored. Examples of conventional flipper colors include white and yellow. Similarly, other playfield components (e.g., slingshots, etc.) are also usually made of opaque materials.

In contrast, in some embodiments described herein, a flipper (or any other pinball component) may be animated, such that the visual appearance of its surface (e.g., its top surface) changes over time. For example, in some implementations, a flipper may display one color at one time and a different color at another time. In other implementations, the opacity of the flipper may change. In yet other implementations, text, shapes or other graphical objects may be drawn or rendered (or appear to be drawn or rendered) on the flipper.

Figure 21A:
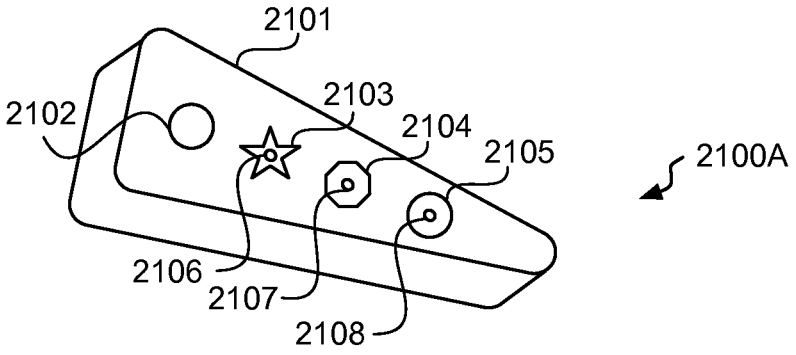
FIGS. 21A-C are a three-dimensional, auxiliary views of examples of animated playfield components according to some embodiments.
Figure 21B:
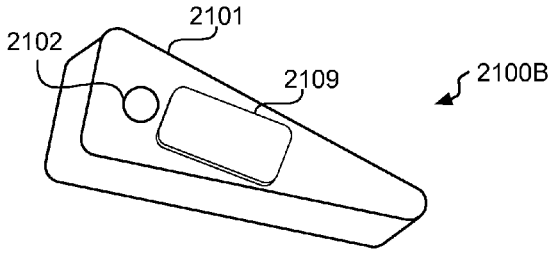
Figure 21C:
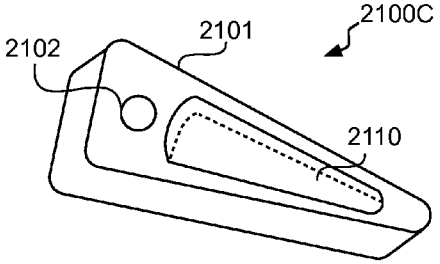

To illustrate these features, FIGS. 21A-C show three-dimensional, auxiliary views of examples of animated flippers according to some embodiments. In each of FIGS. 21A-C, flipper bat portion 2101 is configured to rotate around post 2102 during a pinball game, typically (although not exclusively) under control of a user or player.

With respect to FIG. 21A, the surface of flipper 2100A has different shapes 2103-2105 (e.g., each shape may have a different color), and each shape includes or is optically coupled to a corresponding one of light sources 2106-2108. For example, each of light sources 2106-2108 may include one or more LEDs or the like (e.g., each of light sources 2106-2108 may include a white LED or an array of red, green, and blue LEDs) built or embedded within flipper 2100A, and shapes 2103-2105 may be painted, drawn, carved, and/or inlaid (e.g., plastic or glass) onto the surface of flipper bat portion 2101. As such, when a particular one of light sources 2106-2108 is turned on (or set to a particular color), a corresponding one of shapes 2103-2105 is visible to the user or player. Non-illuminated shapes are not visible, or are at least less visible (e.g., opaque) to the player.

For flipper 2100A to be animated, different ones of light sources 2106-2108 may illuminate corresponding ones of shapes 2103-2105 at a given time. For instance, a particular pinball game may begin without any of light sources 2106-2108 being turned on—thus rendering all of shapes 2103-2105 opaque—and one or more of those light sources may be turned on later during the game, for example, in response to a game event.

For example, if all of elements 2103-2105 have the same shape, turning each of lights 2106-2108 on and off sequentially may give the impression that the shape is moving to different positions across the surface of flipper bat portion 2101. As another example, shape 2103 (or any other shape(s)) may be illuminated when flipper 2100A is in a down position, and shape 2105 (or any other shape(s)) may be illuminated when flipper 2100A is in an up position. As yet another example, shape 2104 (or any other shape(s)) may be caused to "blink" in response to the player reaching a predetermined point or stage in a pinball game (e.g., a bonus round, etc.). As still another example, a first one of shapes 2103-2105 may be lit when a first pinball is being played, a second one of shapes 2103-2105 may be lit when a second pinball is being played, and a third one of shapes 2103-2105 may be lit when a third pinball is being played.

In some of the foregoing examples, when a given one of shapes 2103-2105 is not said to be lit, it may be deemed to be opaque—that is, a corresponding one of light sources 2106-2108 is turned off. Moreover, it should be understood that any number of light sources 2106-2108 and shapes 2103-2105 may be used, and that a one-to-one correspondence between light sources and shapes is not needed. Also, shapes 2103-2105 may have any suitable design, and may match a theme of the game or machine.

In FIG. 21B, the surface of flipper 2100B includes display 2109. For example, display 2109 may include an LCD display similar to electronic display 200 of FIG. 2, but smaller in size to fit the surface of flipper bat portion 2101. In some embodiments, display 2109 may render one or more images during a pinball game. These images may include text, shapes or other graphical objects.

In some cases, display 2109 may provide graphical or textual instructions that teach a player certain aspects of the game such as, for instance, an instant in time when to activate flipper 2100B. This may be achieved, for example, by tracking the position of the pinball across playfield 104, determining a time at which flipper 2100B should be activated in order to prevent the pinball from falling in the drain, accounting for a player reaction time (the time it should take for the player to see an instruction and control the flipper in response), and presenting the instruction to the player via display 2109 so that he or she has a sufficient amount of time to activate flipper 2100B and hit the pinball.

In other cases, display 2109 may indicate a timer countdown, a number or credits left to the player, etc. In yet other cases, display 2109 may provide colorful animations with the goal to entertain the player during the game. For example, display 2109 may show images of fireworks, explosions, etc. matching the theme of the game or machine. In some implementations, the images displayed on display 2109 may be synchronized with images displayed on electronic screen 200 such that flipper bat portion 2101 appears to be at least partially invisible to a player—that is, image(s) on display 2109 appear to be part of the image(s) on electronic screen 200—when flipper bat portion 2101 is static and/or rotating around pivot point 2102.

Here it should be noted that display 2109 may assume any suitable shape and does not need to be rectangular. Display 2109 may, in some cases, cover the entirety of the surface of flipper bat portion 2101. In other cases, display 2109 may be located inside of flipper 2100B and covered with a transparent or translucent materials. Additionally or alternatively, display 2109 may be flush with the surface of flipper bat portion 2101 so that flipper 2100B appears to be a monolithic component.

In FIG. 21C, flipper bat portion 2101 of flipper 2100C includes a hollow, transparent, and/or translucent gap 2110 surrounded by solid or opaque boundary 2111. When flipper 2100C is mounted on playfield 104, gap 2110 allows a player or onlooker to see a portion of electronic display 200 ("flipper portion") directly under gap 2110 and within boundary 2111. The flipper portion of display 200 may, in some cases, comprise a set of pixels having a shape that follows the contour of boundary 2111. Hence, any of the aforementioned types of animation, or any other animation, although actually rendered on electronic display 200 below flipper 2100C, may appear to an onlooker as if rendered on the surface of flipper 2100C.

When flipper bat portion 2101 rotates, gap 2110 moves relative to electronic display 200. In some implementations, by periodically or continually tracking the motion and/or activation of flipper 2100C, graphical renderings in the flipper portion of electronic display 200 may be made to appear to move in a corresponding fashion, thus matching or tracking the movement of gap 2110. As such, different physical portions of electronic display 200 (i.e., different sets of pixels) may provide the surface animation of flipper 2100C when flipper 2100C moves.

For instance, when flipper 2100C is in a first position, the flipper portion of display 200 may consist of a first set of pixels corresponding to the portion of display 200 that a player sees through gap 2110, and that appears (to that player) to be at the surface of flipper 2100C. When flipper 2100C is in a second position, the flipper portion of display 200 may correspond to a second set of pixels that a player then sees. Upon flipper 2100C's return to the first position, the flipper portion of display 200 may change to again encompass the first set of pixels. In some cases, any number of positions may be interpolated so that flipper portions encompass different sets of pixels at different times. Furthermore, at any given time, portions of electronic display 200 that are not directly under gap 2110 at that time may continue to render other images (e.g., background graphics, etc.) that are not intended to appear as if part of the surface of flipper 2100C.

Players of different heights and/or body types may see playfield 104 at different angles, and therefore may have different perspectives on images seen through gap 2110. In some embodiments, a camera or other sensor (e.g., mounted on vertical portion 103, etc.) may be coupled to interface board 402 and may be configured to identify a player's height and/or to track the location of a player's head and/or eyes. Accordingly, the location of a flipper portion of electronic display 200 under gap 2110 that displays images appearing to be rendered on the surface of flipper 2100C may be adjusted to accommodate the player's vision, in some cases in real time, depending upon the player's height, distance from playfield 104, head positioning, and/or eye positioning, such that the images produced by the flipper portion of electronic display 200 during a game appear to be directly under flipper 2100C, regardless of perspective.

Additionally or alternatively, the level (roll, pitch, and/or yaw) of playfield 104 may be used when determining where to position the flipper portion of electronic display 200. To that end, one or more accelerometers used as part of the automatic level detection systems and methods described in more detail below may be used here in order to adjust the location of flipper portions of electronic display 200, and so that the images produced by those flipper portions appear to be directly under flipper 2100C, regardless of the angle(s) with which pinball machine 100 and/or playfield 104 is set up.

In various embodiments, shapes, texts, and/or colors that represent the animations may either be drawn or displayed on the flipper themselves, or may be drawn or displayed in such a way that they appear to be in or on the flippers, even if those animations are not in or on the flippers. In an embodiment, colors that represent animations may be created by LEDs that are placed inside of the flippers or whose light is directed onto the flippers. In another embodiment, small screens such as LCD screens may be attached to the flippers and animations may be drawn or displayed on the screens. In another embodiment, animations may be projected onto the flippers from another source, such as a video projector. In yet another embodiment, flippers may be transparent or semi-transparent, and animations may be drawn or displayed on a screen or screens that are underneath the flippers.

Figure 22:
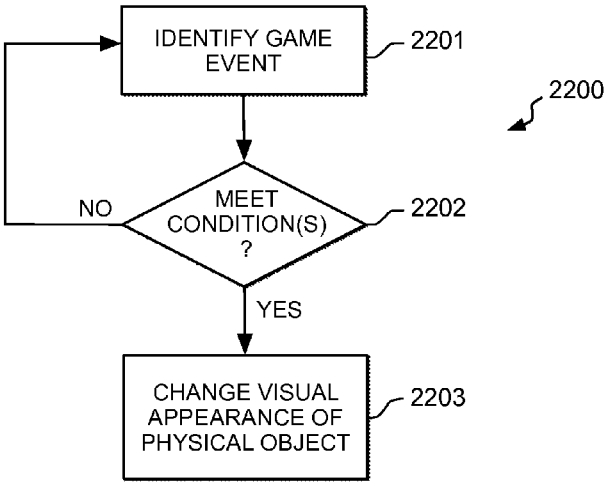
FIG. 22 is a flowchart of an example of a method of animating a playfield component according to some embodiments.

FIG. 22 is a flowchart of an example of method 2200 of animating a playfield component. In some embodiments, method 2200 may be performed, at least in part, by computing system 401 executing software 600 in cooperation with electronic display 200, interface board 402, and/or tracking system 300. At block 2201, method 2200 includes identifying a game event. Examples of events include, but are not limited to, a game having not yet begun, a game having started, a number of credits being available, a stage or a predetermined point in a game being reached, a particular target being hit, a number of pinballs having been used or being available, a number of points being earned, a position of a physical object in the playfield, a speed or direction of the physical object, etc.

At block 2202, method 2200 includes determining whether the event meets a predetermined condition. For example, the position of a physical object may have changed by an amount meeting a threshold value, a minimum number of points may have been earned, and so on. If so, then at block 2203 method 2200 includes changing the visual appearance and/or animating a physical object within the playfield in a preprogramed manner. Otherwise, method 2200 returns to block 2201.

The shapes and colors that comprise animations on physical objects can change over time, often as a result of changing circumstances in gameplay. In some embodiments, text may be displayed on the flipper indicating the shot at which a player should aim, or counting down a timer, or any number of other possibilities. In other embodiments, the animations may appear as lightning bolts, morphing shapes, moving characters, or any number of other possibilities. In yet other embodiments, animations may include all of the previously described items.

The foregoing examples represent but only a few of the numerous ways the flippers or other playfield components may be animated using the systems and method described herein. The term animation applies broadly to the items being displayed on the playfield components that change over time, whether simple colors, shapes, texts, or other graphical objects.

Automatic Level Detection

The manner in which a pinball interacts with the playfield and/or physical objects on the playfield in a pinball machine during a game may be dependent upon the level at which the machine rests. The front-to-back level of a pinball machine, referred to herein as the pitch and illustrated in FIG. 1, determines the speed at which one or more pinballs roll up or down the playfield when not subject to forces other than natural forces imposed by gravity, friction, and/or air resistance. The side-to-side level of a pinball machine, referred to herein as the "roll" and also shown in FIG. 1, determines to which side one or more pinballs rolling on the playfield will be pulled when not under any force other than the aforementioned natural forces. Although the "yaw" of the machine, further shown in FIG. 1, does not often directly affect gameplay, it may provide additional insight into how a pinball machine is installed or whether it is being moved.

Pinball machine manufacturers may sometimes provide instructions as to the pitch and roll levels with which the machine should be set up for optimal play. The roll is typically, but not always, 0 degrees, which means that the side-to-side surface of the playfield is parallel to the surface of the earth or exactly perpendicular to the force of gravity exerted by the earth. Having a side to side level of 0 degrees means any ball rolling on the playfield will not be pulled to either side by the force of the earth's gravity.

Generally speaking, assuming that the ground surface upon which machine 100 sits is flat, the roll of machine 100 is 0 degrees so long as leg 102A has the same length of leg 102B, and leg 102C has the same length as leg 102D, resulting in cabinet 101 resting parallel to the earth (also assuming that the cabinet is the same height on each side and, mounting holes or brackets are provided such that the legs are attached to the cabinet in the same spot on each side). The pitch of machine 100 varies from machine to machine, but it is approximately 6.5 degrees for most pinball machines manufactured in the last twenty years. A pitch of 6.5 degrees means the back of playfield 104 is taller than the front of the playfield 104 by an amount that makes the angle between the surface of the earth and the surface of the playfield 6.5 degrees. In FIG. 1, the pitch of the machine 100 is determined by the lengths of the legs 102A-D. If back legs 102A/B were much longer than front legs 102C/D, the pitch would be greater than if back legs 102A/B had approximately the same length/height as front legs 102C/D.

Setting up a pinball machine to a specific roll and to a specific pitch has traditionally been a very manual process.

Some pinball machine manufacturers include small bubble levels mounted onto machines to aid their owners in setting up the pitch of the machine; although this mechanism does not aid with side-to-side, "roll" leveling. Whether an installer setting up the machine uses the integrated bubble levels or another device, such as his or her own bubble levels, to measure the side to roll level and pitch, setting up the roll and pitch is an iterative and manual process. Generally, a person makes an adjustment to the leveling of the machine, visually checks the bubble level or other device to see the current angle of the side-to-side level and/or pitch, and repeats the process until the machine is set up as desired.

Because the side-to-side and front-to-back levels of a machine have a direct impact on how pinballs roll on the surface of the playfield, the roll and pitch may also very likely affect whether or not a player would want to play the machine. If the roll is non-zero, pinballs will be pulled to one side of the other by the force of gravity, making the game undesirable to play. If the pitch is significantly more or less than the recommended pitch, pinballs will likely roll up and down the playfield far too fast or far too slow, thus also making the game undesirable to play. Moreover, players may not realize that the roll and/or pitch of the machine is not set properly until they start playing the game.

To address these, and other problems, systems and methods described herein provide automatic level detection in pinball machines. In some embodiments, a pinball machine, through a combination of sensors and software code configured to process sensor data, may automatically identify the roll, pitch, and/or yaw at which it rests. In some cases, a pinball machine may provide feedback, whether visual or audible, to the person setting it up (such as an installer) in order to make the setup process less iterative and less manual. Additionally or alternatively, a pinball machine with automatic level detection may be configured to inform prospective players the roll, pitch, and/or yaw of the machine so that they know that information before deciding whether to play the machine. Additionally or alternatively, automatic level detection may be used to detect force applied to the pinball machine by a player.

In some embodiments, one or more accelerometers may be provided within (or mounted onto) a pinball machine by its manufacturer, or may be installed in the machine by a third-party after manufacturing. Referring to FIG. 4, these one or more accelerometers may be communicatively coupled to interface board 402 as one or more of sensors 404. As such, computing system 401 may be configured to retrieve values measured by the accelerometer(s). Also, in some embodiments, the accelerometer(s) may be mechanically coupled to playfield 104, as opposed to cabinet 101, in order to provide a more accurate reading of actual game conditions.

In some implementations, an accelerometer configured to measure the force of gravity in one, two, or three axes may measure the roll, pitch, and/or yaw of the pinball machine to which it is coupled. If two or more single-axis accelerometers are used, each accelerometer may measure the force of gravity on a respective axis, and therefore measure either the roll, pitch, or yaw the machine. For example, two single-axis accelerometers may be arranged orthogonally with respect to each other to measure the roll and pitch of a machine. A third single-axis accelerometer may be used to measure the yaw of the machine. Conversely, a single two- or three-axis accelerometer may be used.

Accelerometers suitable for use as sensor(s) 404 may include piezoelectric, piezoresistive, and/or capacitive components. In some cases, MicroElectro-Mechanical System (MEMS) accelerometers may be used that include an electronic package having cantilever beam(s) with a proof or seismic mass, or the like. As the proof mass is deflected from its neutral position due to the influence of external accelerations, the capacitance between a set of beams changes in a manner proportional to the deflection of the mass, which in turn may be correlated to an acceleration and/or ultimately to the orientation of the pinball machine. More generally, however, the exact device or devices used to measure the leveling of a pinball machine may vary.

Figure 23:
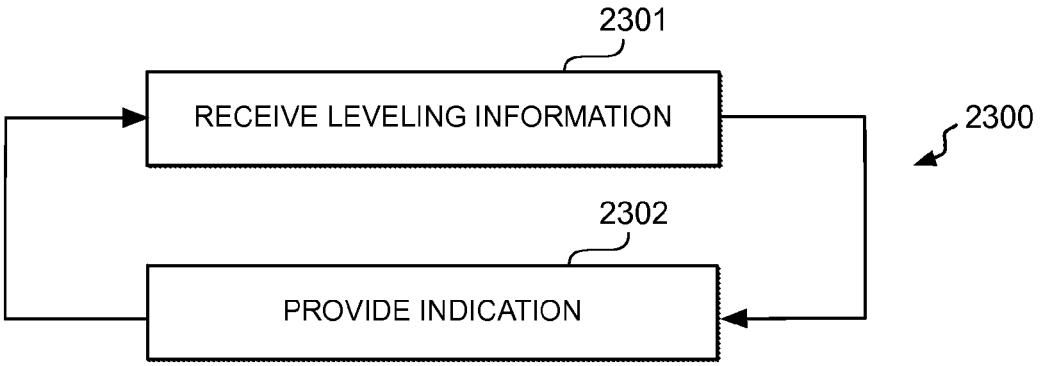
FIG. 23 is a flowchart of an example of a method of processing leveling information according to some embodiments.

FIG. 23 is a flowchart of an example of method 2300 of processing leveling information. In some embodiments, method 2300 may be performed, at least in part, by computing system 401 executing software 600 in cooperation with interface board 402 and/or sensor(s) 404. At block 2301, method 2300 includes receiving leveling information, for example, from one or more accelerometers used as sensor(s) 404. Then, at block 2302, method 2300 includes providing an indication of the leveling information to an installer, player, prospective player, etc.

In some implementations, leveling information may be rendered on electronic display 200. In other implementations, leveling information may be converted to audio signals and played through speakers (e.g., a human voice, beeps, etc.). In yet other implementations, leveling information may be displayed on electronic display 200 and converted to audio signals. In still other implementations, leveling information may be provided via other components within playfield 104. For example, in some cases, a surface of a component (e.g., an animated flipper) may change its visual appearance to convey the leveling information.

In other embodiments, other forms of communication including, but not limited to, network-based communication via email and/or text messages, may be used by computing system 401 to convey leveling measurement data. A pinball machine configured to communicate roll-pitch and/or yaw information may greatly help a person or entity in adjusting the leveling of the machine. A person manually adjusting the side-to-side level, for instance, can continue making adjustments until the audio signal representing the roll of the machine indicates the desired leveling has been achieved.

Moreover, a pinball machine with automatic level detection may also be configured to inform prospective players of the roll and/or pitch of the machine before the prospective players decide to play. By displaying measurements on a display device, by playing audio representing these measurements through speakers, or by providing the measurement information to the prospective player through network communications, the player can understand what the measurements are before deciding whether or not to play a game on that machine.

In some embodiments, software 600 may be configured to disallow a player from playing if the roll and/or pitch of the pinball machine is outside of certain constraints. For example, a pinball machine may be configured to disallow a prospective player from playing if the side-to side-level is more than 1 degree off of 0. A pinball machine may also be configured to disallow somebody from playing if the pitch is more than 2 degrees off of a recommended pitch (e.g., 6.5 degrees).

Furthermore, a pinball machine with automatic level detection may be configured to inform its owner or operator when the roll or pitch of the machine is not ideal. For instance, the machine may notify the owner in any number of ways, such as by displaying a message on electronic display 200 or by playing an audio message through speakers. A network-enabled pinball machine may also notify the owner or operator by sending an email or text message or by some other form of electronic message.

In some embodiments, the automatic level detection systems and methods described above may be used to determine when a player is physically moving the pinball machine. When a player applies a sideways force to the machine, the measured roll level changes briefly, allowing the machine to identify the force being applied by the player. The same is true for front-to-back forces briefly affecting the pitch, and up-and-down forces affecting the yaw. A machine using a two or more axis accelerometer for its automatic level detection, or multiple single-axis accelerometers, may be configured to sense player-applied forces in any or all directions. By identifying these forces, the pinball machine may offer gameplay features that relate the player-created forces to gameplay objectives. Oftentimes a player may apply forces to the machine in an attempt to manipulate a pinball or other object on the machine.

Figure 24:
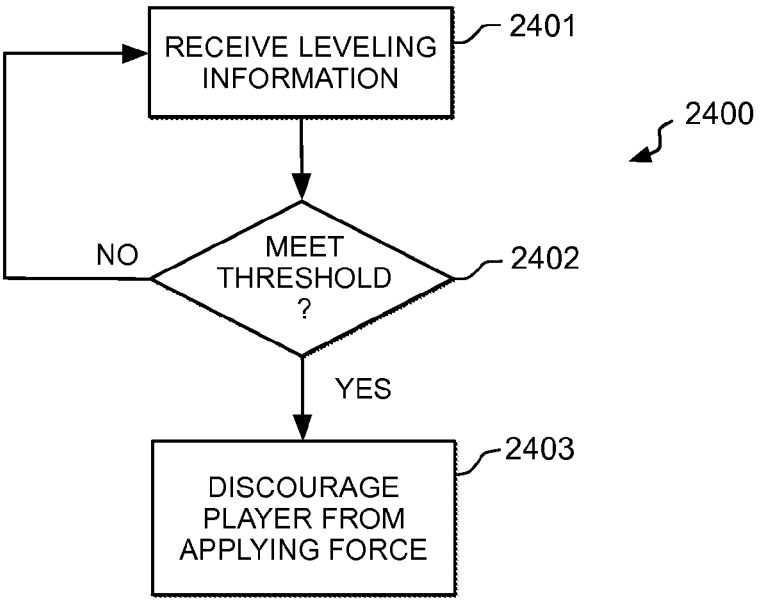
FIG. 24 is a flowchart of an example of a method of discouraging a player from applying force to a pinball machine according to some embodiments.

FIG. 24 is a flowchart of an example of method 2400 of discouraging a player from applying force to a pinball machine. In some embodiments, method 2400 may be performed, at least in part, by computing system 401 executing software 600 in cooperation with interface board 402 and/or sensor(s) 404. At block 2401, method 2400 includes receiving leveling information, for example, from one or more accelerometers. At block 2402, method 2400 includes determining whether the leveling information meets one or more threshold values. For instance, block 2402 may determine whether a rate and/or magnitude of change of the leveling information meets the threshold value(s). If so, then at block 2403 method 2400 includes discouraging the player from applying force to the pinball machine. Otherwise, method 2400 returns to block 2401.

In some implementations, in order to discourage the player from applying force to the pinball machine, block 2403 may include deducting points, reducing the number of pinballs available, taking away credits, increasing the speed of a countdown timer, reducing the length of a game, ending the game early, making it harder for the player to complete an objective (e.g., presenting additional targets to shoot), disabling a control (e.g., a flipper), etc. In some cases, by negatively affecting gameplay in a suitable manner, method 2400 may discourage the player from physical moving the pinball machine (and potentially damaging the machine). In other implementations, in order to discourage the player from applying force to the pinball machine, block 2403 may include acknowledging, via audio, video, or some other interaction with the player, that the machine knows the player is applying forces to the machine. In yet other implementations, block 2403 may include notifying an owner or operator (e.g., via network communications) that force is being applied to the machine.

Figure 25:
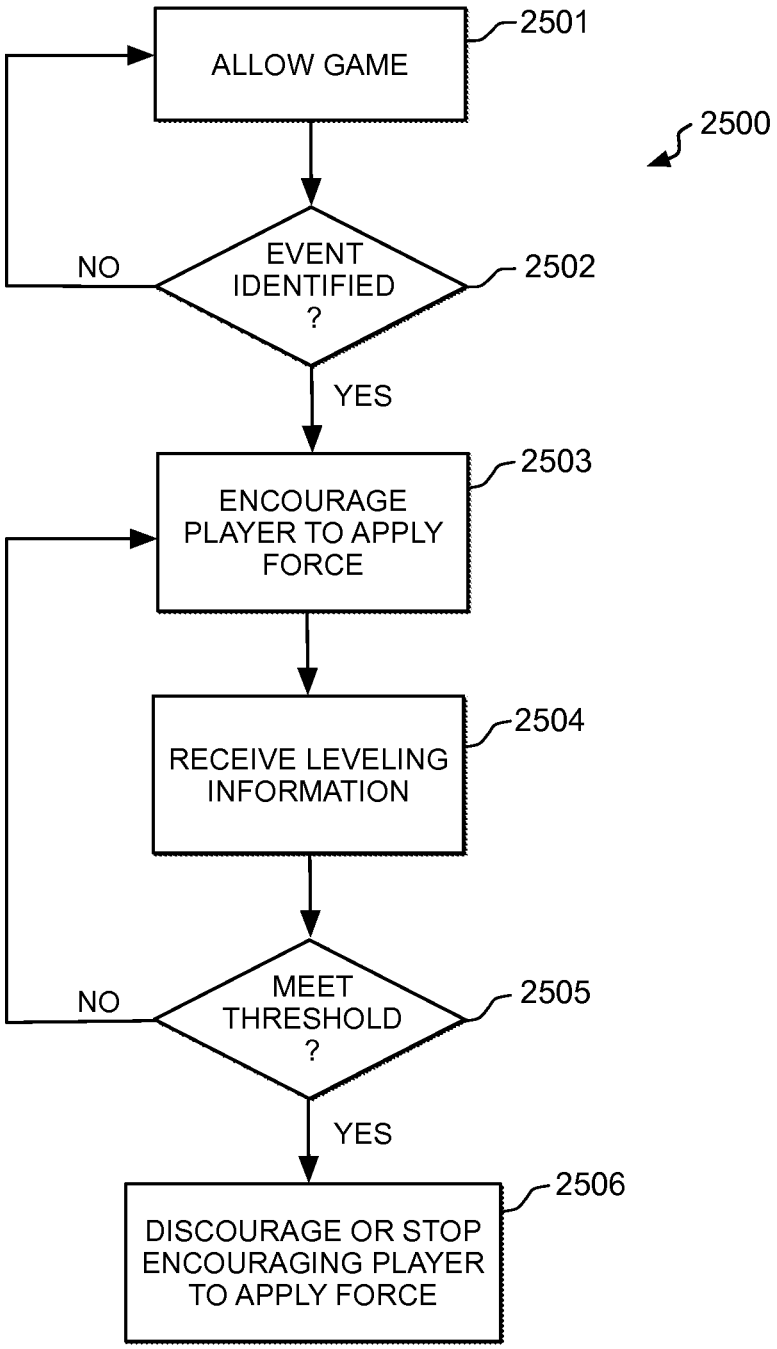
FIG. 25 is a flowchart of an example of a method of encouraging a player to apply force to a pinball machine according to some embodiments.

FIG. 25 is a flowchart of an example of method 2500 of encouraging a player to apply force to a pinball machine. In some embodiments, method 2500 may be performed, at least in part, by computing system 401 executing software 600 in cooperation with interface board 402 and/or sensor(s) 404. At block 2501, method 2500 may include allowing a game to be played. At block 2502, method 2500 may include identifying a game event. Again, examples of game events include, but are not limited to, a stage or a predetermined point in a game being reached, a particular target being hit, a number of pinballs having been used or being available, a number of points being earned, a position of a physical object in the playfield, a speed or direction of the physical object, etc. If not, method 2500 returns to block 2501. Otherwise, method 2500 proceeds to block 2503.

At block 2503, method 2500 includes encouraging a player to apply force to the pinball machine. For example, method 2500 may include providing an indication via audio, video, etc., that the player should apply external forces to the machine. At block 2504, method 2500 includes receiving leveling information, for example, from one or more accelerometers. At block 2505, method 2500 includes determining whether the rate and/or magnitude of change of the leveling information meets threshold value(s). If so, method 2500 may reward the player by awarding point, credits, or extra pinballs, or by rendering a virtual object, stop rendering the virtual object, or animating the virtual object on an electronic display (e.g., shaking a fruit out of a tree, shaking a box off of a table, etc.). The method may then proceed to block 2506. Otherwise, if the rate and/or magnitude of change of the leveling information does not meet the threshold value(s), method 2500 returns to block 2503 where the player is again encouraged to apply forces, or greater forces, to the machine.

At block 2506, method 2500 includes discouraging or stop encouraging the player from applying forces to the machine. For example, once a game objective has been reached, method 2500 may warn or notify the player to stop moving the machine. Additionally or alternatively, if the rate and/or magnitude of change of the leveling information meets another (higher) threshold value(s), thus indicating that the player is making use of excessive force that can damage the machine, method 2500 may begin penalizing the player (e.g., by deducting points, available pinballs left, etc.) if he or she continues to move the machine.

In some embodiments, automatic level detection may also help handicap machines in multi-machine tournaments. For example, assume a tournament using two machines with otherwise the same pinball game, except that one is set up with a 6-degree pitch and the other with an 8-degree pitch. In this case, the 8-degree machine will have a faster playfield and therefore will be more difficult to play. Similarly, different rolls may also cause one machine to be harder to play than the other. Accordingly, in some cases, game software executed by computing system 401 may take the machine's automatically detected level into account to adjust scoring or some other aspect of gameplay. For instance, in the foregoing example, if it is determined that a given target in the 8-degree machine is twice as hard to hit than a corresponding target in the 6-degree machine, the 8-degree machine may be set up to award twice the amount of points than the 6-degree machine when that target is hit. Alternatively, the 6-degree machine may be set up to award half the amount of points than the 8-degree machine when the target is hit. In other cases, the 8-degree machine may allow a player more time to complete an objective than the 6-degree machine, the 8-degree machine may provide an additional bonus round or pinball(s) than the 6-degree machine, etc.

Also, still referring to multi-machine tournaments, the automatic level detection techniques discussed herein may be particularly useful when the machines are set up in different geographical or physical locations (e.g., connected via a network) so that an organizer can determine whether the various machines are set up similarly.

It should be understood that the various operations described herein, particularly in connection with FIGS. 7-12 and 22-25, may be implemented in software executed by processing circuitry, hardware, or a combination thereof. The order in which each operation of a given method is performed may be changed, and various elements of the systems illustrated herein may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. For example, although presented in the context of pinball machines, various systems and methods described herein may be implemented in other types of amusement games. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A pinball machine comprising a physical playfield, wherein the pinball machine is configured to allow a user to cause a physical ball to move within the physical playfield over the playfield's surface, the pinball machine further comprising:

a memory configured to store instructions; and processing circuitry operably coupled to the memory, the processing circuitry configured to execute the instructions to:

receive information regarding the leveling of the playfield's surface with respect to the ground during a pinball game, wherein the information includes at least one of pitch, roll, or yaw detected by one or more accelerometers coupled to the physical playfield, and actively discourage, during the pinball game, a player from applying force to the physical playfield in response to the received information, and/or actively encourage, during the pinball game, the player to apply force to the physical playfield in response to an event occurring during the pinball game.

2. The pinball machine of claim 1, wherein the processing circuitry is further configured to execute the instructions to cause the pinball machine to provide at least one of: a textual, graphical, or audio indication of the received information.

3. The pinball machine of claim 2, wherein the indication is provided to a computing device remotely located with respect to the pinball machine, at least in part, via a telecommunications network.

4. The pinball machine of claim 1, wherein the processing circuitry is configured to execute the instructions to:

actively encourage, during the pinball game, the player to apply force to the physical playfield in response to the event occurring during the pinball game.

5. The pinball machine of claim 4, wherein to encourage the player to apply force, the processing circuitry is configured to execute the instructions to perform at least one of: award one or more points, award a credit, award an extra pinball, render a virtual object on a display, stop rendering the virtual object on a display, or animate a virtual object on the display.

6. The pinball machine of claim 1, wherein the processing circuitry is configured to execute the instructions to:

actively discourage, during the pinball game, the player from applying force to the physical playfield in response to the received information meeting a value.

7. The pinball machine of claim 4, wherein the processing circuitry is configured to execute the instructions to stop encouraging the player to apply force in response to the information meeting a value.

8. The pinball machine of claim 6, wherein to actively discourage the player from applying force, the processing circuitry is configured to execute the instructions to perform at least one of: take away one or more points, take away a credit, take away a pinball, increase a speed of a countdown timer, present a target to shoot, or disable a control.

9. A pinball machine comprising:

a physical playfield;

one or more accelerometers mechanically coupled to the physical playfield;

a memory configured to store instructions; and processing circuitry operably coupled to the memory and operable to execute the instructions to:

receive information regarding a positioning of a surface of the physical playfield relative to a gravitational force, wherein the information includes at least one of pitch, roll, or yaw detected by the one or more accelerometers, and actively discourage, during a pinball game, a player from applying force to the physical playfield in response to the received information, and/or actively encourage, during the pinball game, the player to apply force to the physical playfield in response to an event occurring during the pinball game.

10. The pinball machine of claim 9 further comprising an output device, the processing circuitry being operable to execute the instructions to cause the output device to provide at least one of: a textual, graphical, or audio indication of the information.

11. The pinball machine of claim 9, wherein the processing circuitry is operable to execute the instructions to allow the player to start the pinball game on the physical playfield in response to the received information meeting a threshold value.

12. The pinball machine of claim 9, wherein the processing circuitry is configured to execute the instructions to:

actively encourage, during the pinball game, the player to apply force to the physical playfield in response to the event occurring during the pinball game.

13. The pinball machine of claim 9, wherein the processing circuitry is configured to execute the instructions to:

actively discourage, during the pinball game, the player from applying force to the physical playfield in response to the received information meeting a value.

14. A pinball machine comprising:

a physical pinball playfield;

one or more accelerometers mechanically coupled to the physical pinball playfield, the one or more accelerometers being configured to detect at least one of pitch, roll, or yaw of a surface of the physical pinball playfield relative to a gravitational force;

a memory configured to store instructions; and processing circuitry operably coupled to the memory and operably coupled to the one or more accelerometers, the processing circuitry being operable to execute the instructions to:

receive the detected at least one of pitch, roll, or yaw during a pinball game, identify an occurrence of a predetermined event during a pinball game, actively encourage, during the pinball game and in response to the predetermined event occurring, a player to apply force to the physical pinball playfield until the detected at least one of pitch, roll, or yaw meets a threshold value, and actively discourage, during the pinball game and in response to the detected at least one of pitch, roll, or yaw meeting the threshold value, the player from applying a force to the physical pinball playfield.

* * * * *